US006082971A

United States Patent [19]

Gunn et al.

[11] Patent Number: 6,082,971

[45] Date of Patent: Jul. 4, 2000

[54] COMPRESSOR CONTROL SYSTEM AND METHOD

[75] Inventors: John T. Gunn, Charlotte; William H. Harden, Yadkinville; Don John Gerhardt, Clemmons, all of N.C.

[73] Assignee: Ingersoll-Rand Company, Woodcliff Lake, N.J.

[21] Appl. No.: 09/183,250

[22] Filed: Oct. 30, 1998

[51] Int. Cl.[7] ..... F04B 49/00

[52] U.S. Cl. ..... 417/32; 417/34; 417/53

[58] Field of Search ..... 417/32, 34, 53, 417/364

[56] References Cited

U.S. PATENT DOCUMENTS 5,820,352 10/1998 Gunn et al. ..... 417/53

5,967,757 10/1999 Gunn et al. ..... 417/34

*Primary Examiner*—Tony M. Argenbright

*Attorney, Agent, or Firm*—Michael M. Gnibus

[57] ABSTRACT

A method for optimizing the operating efficiency of a compressor having a compression module for compressing a fluid, the compression module including an inlet for receiving the fluid and an outlet for discharging compressed fluid, the compressor including a prime mover for driving the compression module and a rotatable fan for drawing ambient air into the compressor. The compressor includes a first temperature sensor for sensing the temperature of compressed fluid discharged from the compression module, a second temperature sensor for sensing the temperature of a coolant circulating through the prime mover, a third temperature sensor for sensing the temperature of the fluid entering the compression module, and a fourth temperature sensor for sensing the temperature of a lubricant mixed with the fluid as the fluid is compressed in the compression module. The compressor includes an electronic control module (ECM) electrically connected to the four temperature sensors for receiving signals therefrom. The ECM includes a non-volatile memory containing empirical data relating to optimal operating set points of the compressor and a logic routine for controlling the rotational speed of the fan and the volume of the lubricant mixed with the fluid so as to optimize the efficiency of the compressor. The method includes the steps of executing a temperature sensing subroutine whereby the first, second, third and fourth temperature sensors collect temperature data and relay the temperature data to the ECM, executing a fan speed subroutine whereby the ECM generates signals in response to the temperature data received by the ECM for controlling the rotational speed of the fan, and executing a lubricant volume control subroutine whereby the ECM generates signals in response to the temperature data received by the ECM for controlling the volume of the lubricant mixed with the fluid in the compression module.

19 Claims, 15 Drawing Sheets

COMPRESSOR CONTROL SYSTEM AND METHOD

The present invention is related to commonly-assigned U.S. patent application Ser. No. 08/823,780 filed Mar. 24, 1997, now U.S. Pat. No. 5,967,757, the disclosure of which is hereby incorporated by reference herein.

BACKGROUND OF THE INVENTION

The invention relates to a control system for a machine and more particularly to a microprocessor-based control system for a compressor where the operation of the compressor is controlled by an electronic control module which processes actual compressor operating parameter value signals received at regular intervals from compressor sensors, and if one or more of the parameter values is not at a predetermined set point value, the electronic control module generates and transmits signals for modifying operation of the compressor.

Control systems for compressors typically use pneumatically or mechanically actuated devices to control compressor components such as compressor inlet valves. For example, one such control device changes the size of the opening in the inlet valve for modifying the volume of fluid, such as air, supplied to the compressor.

Conventional compressors and their associated control devices are typically designed to operate within an ambient operating temperature range of approximately −20 to 115 F. These conventional compressors generally operate in an efficient manner within the ambient operating temperature range, however, when the compressor is operated outside the ambient operating temperature range, such as in extremely cold or hot conditions, the pneumatically and mechanically actuated control devices described above frequently do not operate as required and the efficiency of the compressor is significantly reduced. Operating the compressor at such reduced efficiency may lessen the life of the compressor bearings, increase noise and vibration produced by the compressor and significantly increase the frequency of repairs. Additionally, the useful life of the compressor may be reduced when using these conventional pneumatically and mechanically actuated compressor control devices.

There are a number of other problems associated with pneumatic and mechanical controls devices. First, such devices have a very large number of discrete component parts which, because such devices rely on fluid flow through the devices, do not operate properly even when the compressor is operated within the designed ambient operating temperature range. In addition, the component parts may stick or freeze in cold temperatures (e.g., near freezing). Also, pneumatic and mechanical control devices have a limited useful life and, over time, the component parts wear out and must be repaired or replaced. As such, the reliability of these conventional control devices is low while the cost to repair and maintain these control devices is high.

One type of compressor includes an oil flooded screw compressor, which introduces oil into a compression module for absorbing at least some of the heat generated during compression. Thus, at high ambient temperatures and full load conditions the amount of oil used should be increased to allow for sufficient cooling. However, at low ambient temperatures and under partial loading conditions, the amount of oil utilized may be lowered because less oil is required for cooling. It is important that the volume of oil utilized be continuously modified as the load capacity of the compression module changes because injecting more oil into the system than necessary will result in excessive power consumption. Thus, although it is highly desirable to inject the exact amount oil required to maintain the temperature of the compressor within a desired range, conventional compressors do not have the capability to modify the flow of oil to obtain optimum performance.

In addition, with conventional compressors, neither the speed of the prime mover nor the position of the compressor inlet valve may be changed independently of one another. In other words, the inlet valve may not be opened or closed without also increasing or decreasing the speed of the prime mover. This rigid interrelation between inlet valve position and prime mover speed limits a compressor operator's ability to obtain the desired compressor discharge pressure.

The foregoing illustrates limitations known to exist in present devices and methods. Thus, It is apparent that it would be advantageous to provide an alternative to thereby overcome one or more of the limitations set forth above. Accordingly, a suitable alternative is provided including features more fully disclosed hereinafter.

SUMMARY OF THE INVENTION

In one aspect of the present invention, this is accomplished by providing a compressor control system including at least one machine sensor for sensing at least one machine operating parameter; and an electronic control module in signal receiving relation with each of the at least one machine sensors, the control module comprising a logic routine for controlling the operation of the machine, the logic routine comprising a machine startup routine, a machine shutdown routine, a machine alert routine, a fan speed and oil volume control routine, a machine speed control routine, a machine discharge pressure control routine, a 5 millisecond control routine and a 25 millisecond interrupt control routine. The system also includes a diagnostics panel in signal transmitting and signal receiving relation with the electronic control module.

Preferred embodiments of the present invention disclose a method for optimizing the operating efficiency of a compressor having a compression module for compressing a fluid. The compression module preferably includes an inlet for receiving the fluid and an outlet for discharging compressed fluid. The compressor may include a prime mover for driving the compression module and a rotatable fan for drawing ambient air into the compressor. The compressor preferably has a first temperature sensor for sensing the temperature of the compressed fluid discharged from the compression module, a second temperature sensor for sensing the temperature of a coolant circulating through the prime mover, a third temperature sensor for sensing the temperature of the fluid entering the compression module, and a fourth temperature sensor for sensing the temperature of a lubricant mixed with the fluid as the fluid is compressed in the compression module. The compressor preferably includes an electronic control module (ECM) electrically connected to the first, second, third and fourth temperature sensors for receiving signals therefrom, the ECM including a non-volatile memory containing empirical data relating to optimal operating set points for the compressor. The ECM also preferably includes a logic routine for controlling the rotational speed of the fan and the volume of the lubricant mixed with the fluid so as to optimize the efficiency of the compressor.

The method may comprise the steps of executing a temperature sensing subroutine including the steps of: (i) sensing the actual temperature of the compressed fluid discharged from the outlet of the compression module; (ii) sensing the actual temperature of the coolant circulating through the prime mover; (iii) sensing the actual temperature of the fluid entering the inlet of the compression module; (iv) sensing the actual temperature of the lubricant mixed with the fluid in the compression module; and (v) sending the temperature data compiled in subroutine steps (i)–(iv) to the ECM.

After the temperature sensing subroutine, the method preferably includes the step of executing a fan speed subroutine for modulating the rotational speed of the fan which may comprise the steps of: (i) comparing the actual temperature of the compressed fluid discharged from the compression module with a set point compressed fluid discharge temperature stored in the ECM memory; (ii) increasing the speed of the fan if the actual temperature of the compressed fluid discharged from the compression module is greater than the set point fluid discharge temperature stored in the ECM memory; (iii) comparing the actual prime mover coolant temperature with a set point prime mover coolant temperature stored in the ECM memory; (iv) decreasing the speed of the fan if the actual prime mover coolant temperature is less than the set point prime mover coolant temperature; and (v) proceeding to the lubricant volume control subroutine if the actual prime mover coolant temperature is greater than the set point temperature stored in the ECM memory.

The method then preferably includes the steps of executing a lubricant volume control subroutine comprising the steps of: (i) subtracting the actual temperature of the lubricant mixed with the fluid in the compression module from the actual temperature of the fluid entering the inlet of the compression module for calculating an actual temperature differential; (ii) comparing the actual temperature differential calculated in step (i) with a predetermined set point temperature differential stored in the ECM memory; (iii) increasing the volume of the lubricant mixed with the fluid in the compression module if the actual temperature differential is greater than the predetermined set point temperature differential; and (iv) decreasing the volume of the lubricant mixed with the fluid in the compression module if the actual temperature differential is less than the predetermined set point temperature differential.

The foregoing and other aspects will become apparent from the following detailed description of the invention when considered in conjunction with the accompanying drawing figures.

DESCRIPTION OF THE DRAWING FIGURES

Figure 4:
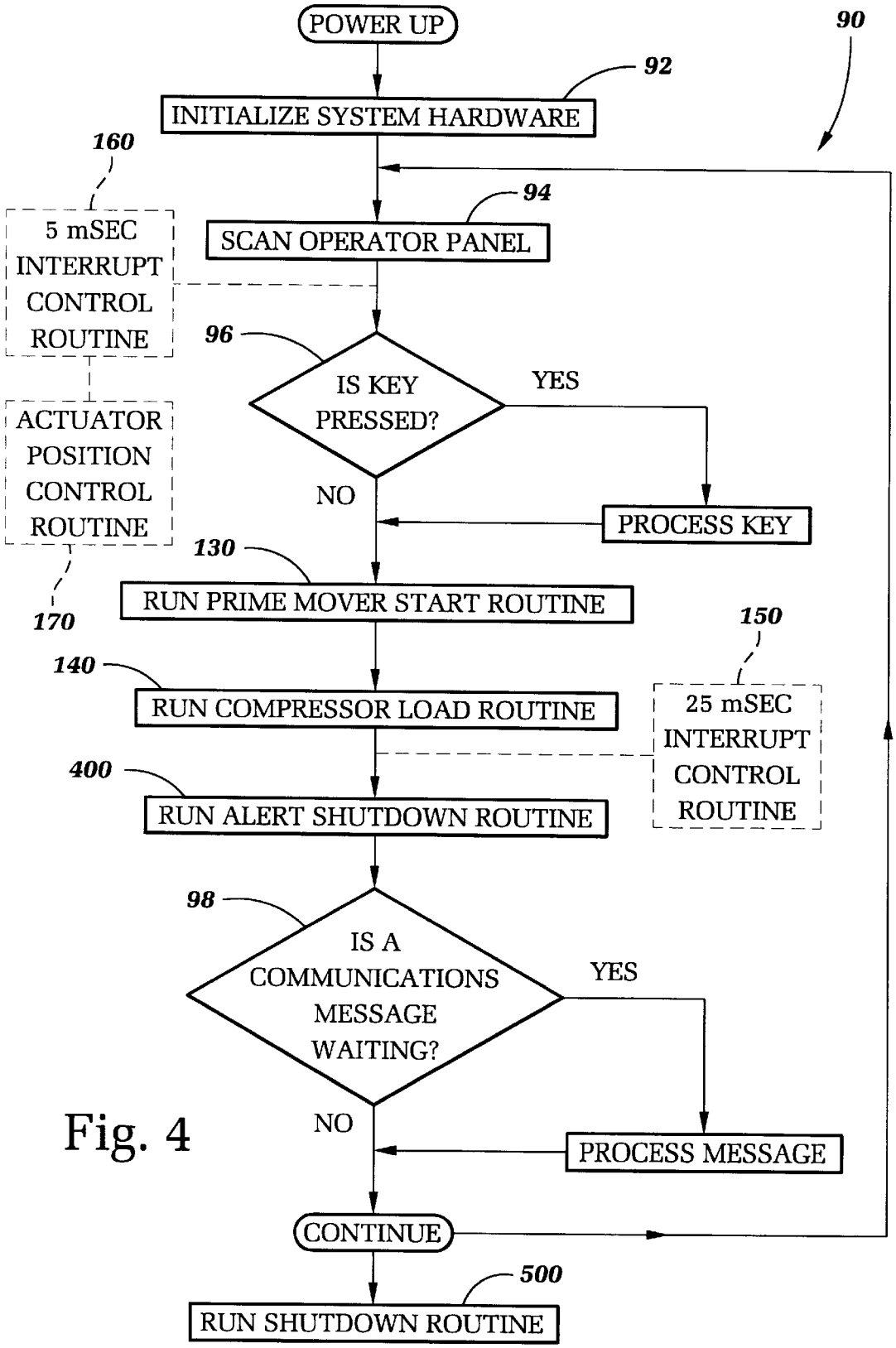
FIG. 4 shows a flowchart illustrating the logic for the main logic routine of the compressor control system of the present invention.
Figure 13:
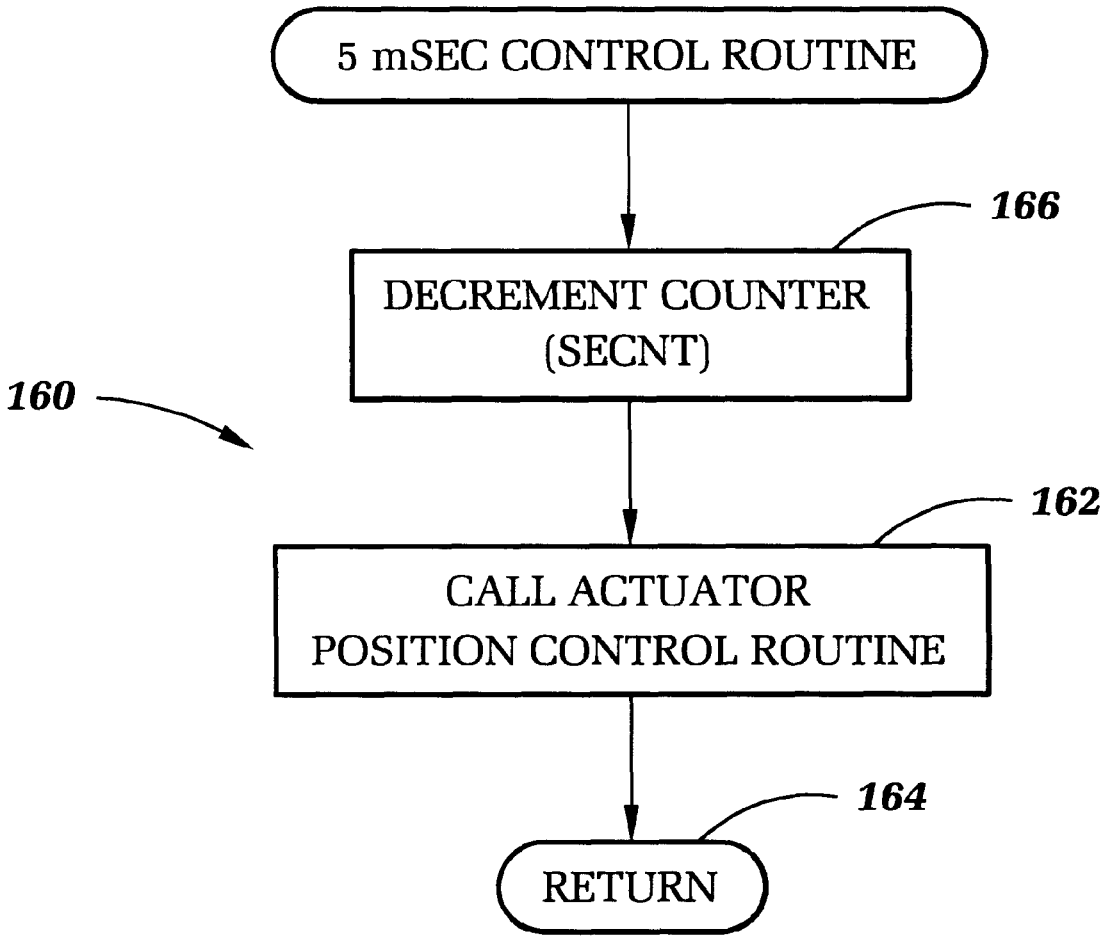
Figure 14:
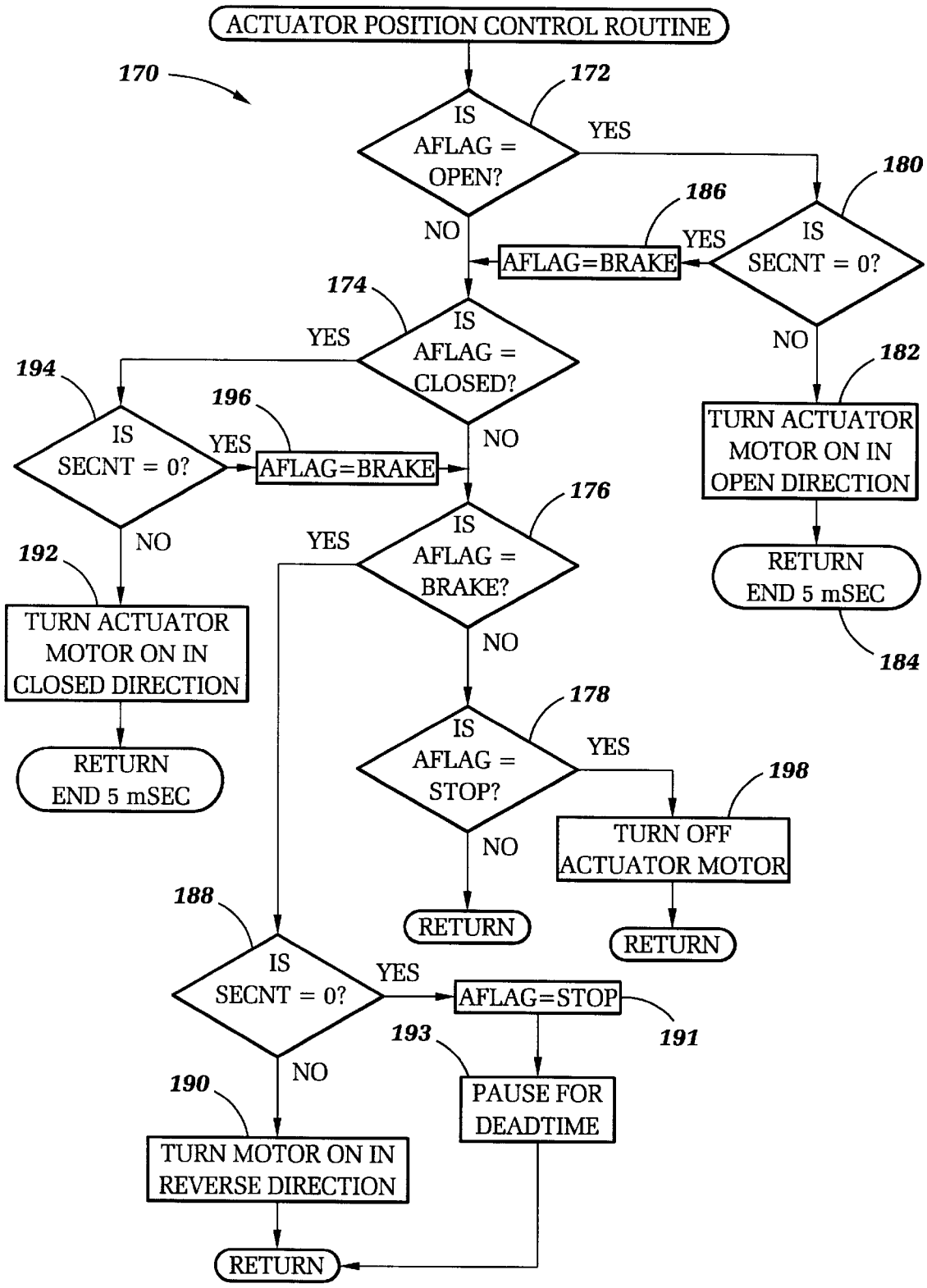

FIG. 13 shows a flowchart illustrating the 5 millisecond control routine identified as step 160 in FIG. 4; and FIG. 14 shows a flowchart illustrating the actuator position control routine identified as step 170 in FIG. 4.

DESCRIPTION OF THE PREFERRED EMBODIMENT

Figure 1:
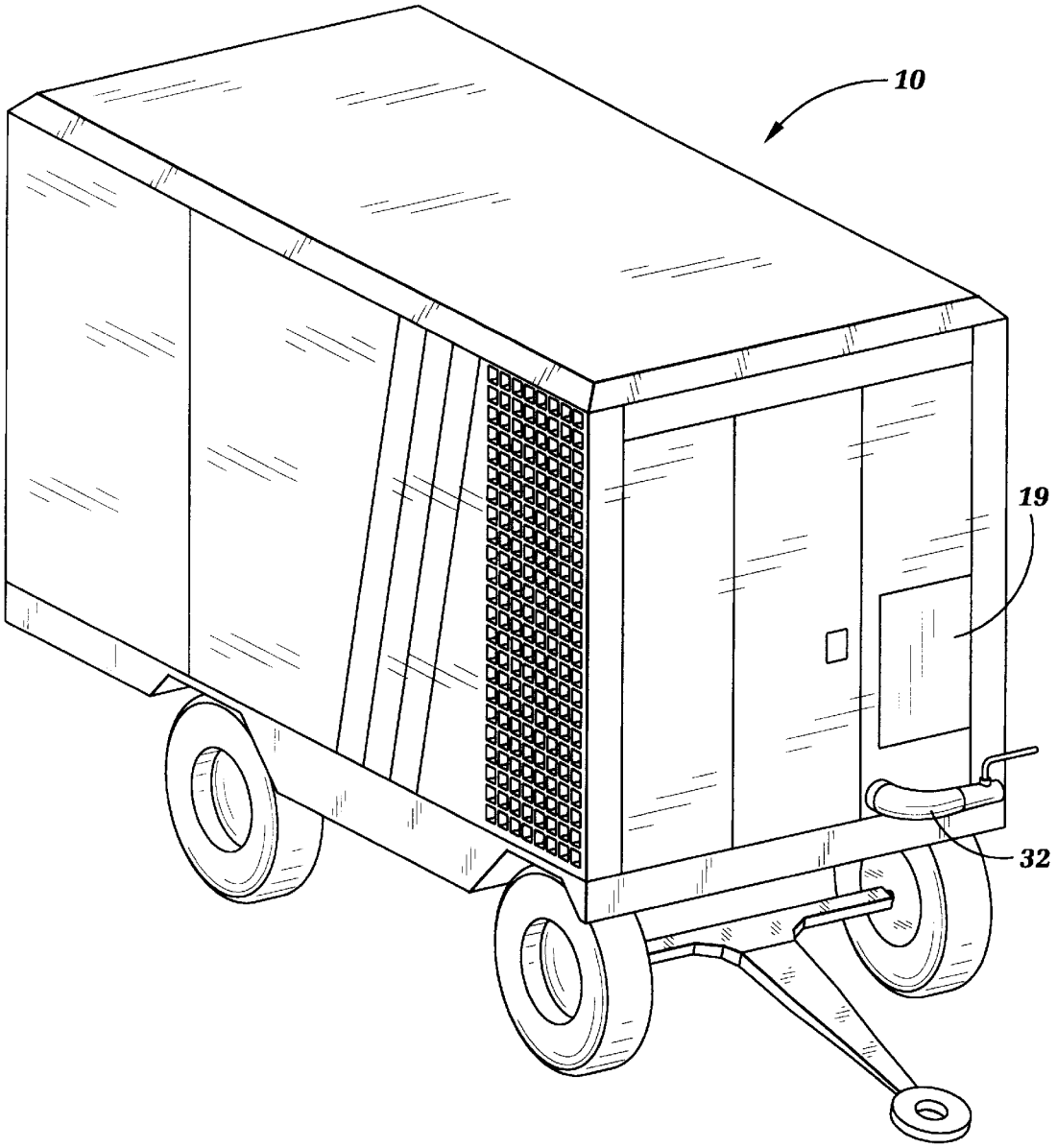
FIG. 1 shows a perspective view of a portable compressor including a compressor control system in accordance with certain preferred embodiments of the present invention.

Turning now to the drawings wherein like compressor components and compressor controller logic steps are referred to by the same number throughout the several views, FIG. 1 shows an isometric view of a portable compressor 10 that includes the compressor control system 40 of the present invention. The compressor control system electronically monitors and controls the startup, operation, and shutdown of the compressor.

The compressor includes a display control panel 60 (described in detail in FIG. 2) which is protected from harmful dirt and debris by panel door 19. The door is preferably hingeably connected to the compressor body and may be opened and closed by a compressor operator as required. Discharge valve 32 extends from the compressor housing.

Figure 2:
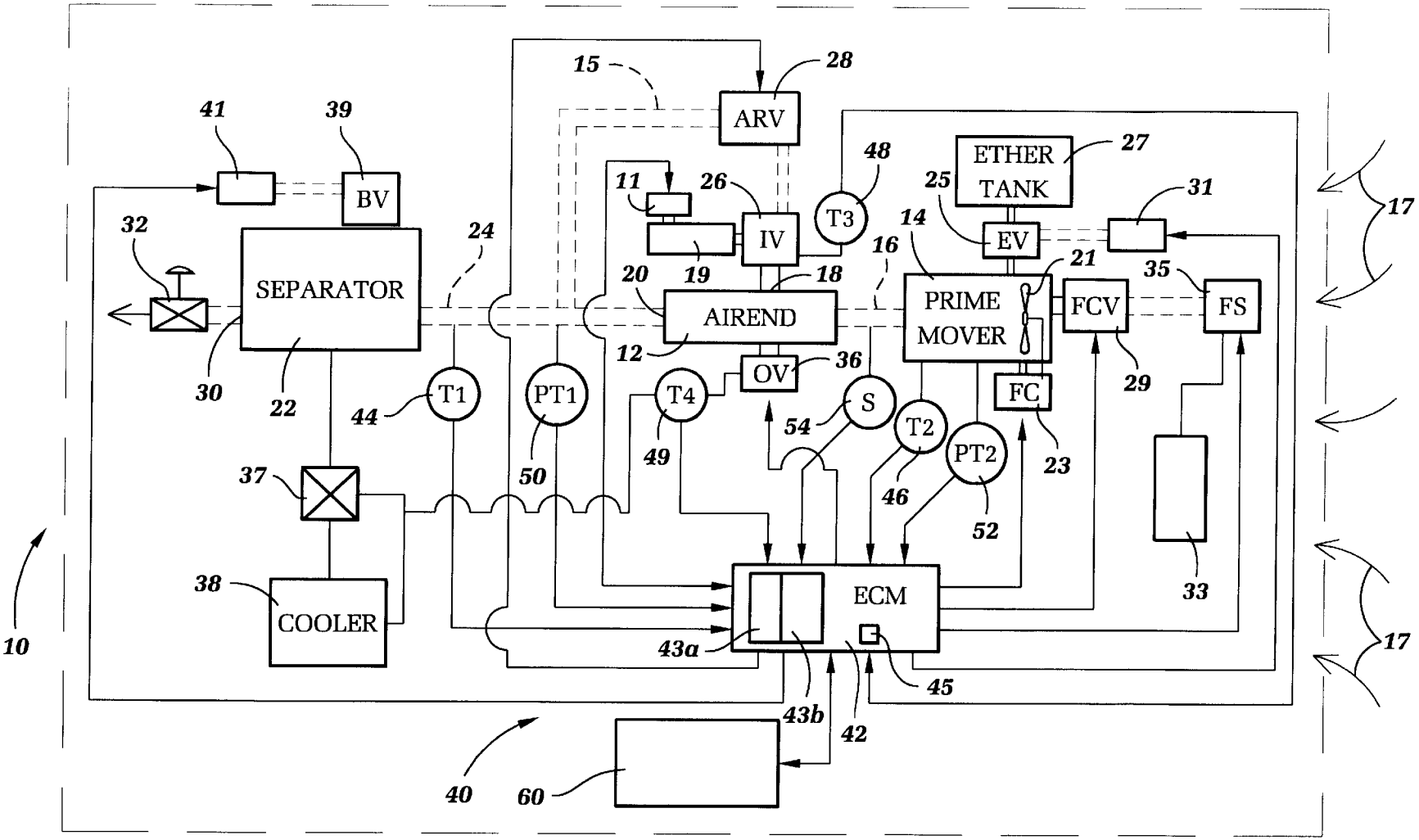
FIG. 2 shows a schematic representation of the portable compressor of FIG. 1.

With the exception of the control system, the compressor 10 is of conventional design well known to one skilled in the art, and includes a compression module or airend 12 that is driven by a prime mover 14 which includes an output shaft (not shown) which in turn is operably connected to the compression module by coupling 16 shown schematically in FIG. 2. The prime mover produces rotary motion that drives the compression module. The compression module, prime mover and coupling are all well known to one skilled in the art. For purposes of describing the preferred embodiment of the invention, the compression module or airend 12 is an oil-flooded rotary screw type airend with male and female interengaging rotors (not shown), and the prime mover 14 is a diesel engine. However, it should be understood that the compression module 12 may be an oilless rotary screw type airend and the prime mover may be a spark ignition engine.

The compression module has an inlet port 18 and a discharge port or outlet 20, shown schematically in FIG. 2. The prime mover includes a fan 21, which draws fluid such as ambient air into the compressor package in the direction of arrows 17. The fan 21 is preferably operably connected to a fan clutch "FC", referred to at 23, which is used to alter the speed of the fan. Ether valve "EV", referred to at 25 flow connects ether supply tank 27 to prime mover 14. The ether supply tank contains a volume of ether that may be flowed into the prime mover through ether valve 25 as required, to help start the compressor prime mover. An ether valve solenoid 31 is operably connected to the valve 25 and opens and closes the ether valve in a conventional manner.

A prime mover fuel control valve "FCV" referred to at 29 is flow connected to a fuel solenoid valve "FS", 35 which in turn is flow connected to a suitable fuel supply tank 33. During operation of compressor 10, the volume of fuel supplied to the prime mover is precisely controlled by the FCV. The fuel solenoid is a main supply valve that generally opens or closes the flow of fuel from the supply tank 33 to the FCV. The FS is closed when the prime mover is shut down and is open when the prime mover is operating. By increasing or decreasing the volume of fuel supplied to the prime mover through the FCV, the rotational speed of the prime mover 14 is likewise increased or decreased.

For purposes of clarity, the term "fluid" shall mean any gas, or liquid. The term "parameter" shall mean any condition, level or setting for the compressor. Examples of compressor operating parameters include discharge pressure, discharge fluid temperature, and prime mover speed. Additionally, the terms "lubricant" and "coolant" as used herein shall mean the fluid that is supplied to the compression module and mixed with the compressible fluid during compressor operation. One preferred lubricant includes oil.

An inlet valve "IV" referred to at 26, is flow connected to the inlet 18 of compression module 12 and antirumble valve "ARV" referred to at 28, is flow connected to the inlet valve. The inlet valve is described in U.S. Pat. No. 5,540,558 which is incorporated herein by specific reference. As described in detail in the '558 patent, the inlet valve precisely controls the volume of gas flowed to the compression module through inlet 18, and prevents backflow through the inlet valve. The inlet valve uses a linear actuator 19 driven by a conventional DC motor with brushes 11, to precisely position the inlet valve. The motor is in electronic pulse receiving relation with the electronic control module 42.

A lubricant such as oil is supplied to the compression module through lubricant valve "OV", referred to at 36. The lubricant valve 36 is flow connected to a lubricant cooler 38 which in turn is flow connected to separator 22. A thermal relief valve 37 is connected to the flow line that connects the separator 22 and cooler 38.

As the inlet gas, such as air for example, is flowed into compression module 12 through the inlet valve 26 and inlet 18, a lubricant such as oil is injected into the compression chamber of compression module 12, and is mixed with the fluid during compression. The mixture of compressed gas and lubricant is then flowed out the compressor discharge port 20 through flow line 24 and into a conventional separator tank 22 which is flow connected in mixture receiving relation with the compression module 12 by the flow line 24. The separator serves to substantially separate the lubricant from the compressed gas. The substantially lubricant-free compressed gas is flowed from the separator tank outlet 30 through compressor discharge valve 32 to an object of interest such as a pneumatic tool for example. The separated lubricant is collected in separator tank 22 and cooled by flow through the lubricant cooler 38.

Blowdown valve, "BV", referred to at 39 is also flow connected to the separator tank. The blowdown valve is typically closed during compressor operation and is only opened when the compressor is shutdown, to reduce the pressure in the separator tank 22. Opening and closing of the blowdown valve is controlled by blowdown valve solenoid 41.

Compressor Control System

Referring to FIG. 2, during operation of compressor 10, the compressor control system 40 continuously monitors values of a number of key compressor operating parameters sensed by associated sensors. The compressor control system 40 compares the sensed values of the key parameters to predetermined set point parameter values stored in a memory of an electronic control module. If at least one of the operating parameters does not match the respective set point parameter value stored in the electronic control module, the orientation, position, speed or other operating parameter of the compressor component(s) which affect the operating parameter is precisely controlled by the electronic control module. In this way, the compressor control system 40 maintains the operating parameters of the compressor at values required to maximize the operating efficiency of the compressor and produce the required discharge pressure.

The electronic control module or "ECM" is referred to at 42 in FIG. 2. The ECM is programmed to include a logic routine illustrated generally in flowchart FIGS. 4–14. The ECM logic routine is comprised of a main logic routine or loop identified at 90 in FIG. 4, and a number of subroutines or loops 100, 120, 140, 150, 160, 170, 400, and 500. The logic routine compares actual, sensed compressor operating parameters to the set point parameter values stored in the ECM memory 43*a* to ensure that the compressor is operating properly and efficiently. If the ECM 42 determines that the compressor is not running as required (i.e., at or within the range of the predetermined set point parameter values), the operation of the compressor is adjusted by the ECM routine. The various ECM logic routines are generally illustrated in FIGS. 4–14 and will be described in greater detail below.

In general, the ECM 42 is a microprocessor-based system with memory 43 comprised of volatile and non-volatile memory identified respectively at 43*a* and 43*b* in FIG. 2. The ECM rapidly and continuously executes the main software control loop 90. The ECM includes an interrupt counter 45 that measures the time intervals between operation of interrupt control routines 150 and 160. The execution of the main control loop is interrupted every 25 milliseconds, msec, to execute an interrupt control loop 150 shown in dashed font in FIG. 4; and is interrupted every 5 msec to execute interrupt control loop 160 also represented in dashed font in FIG. 4. The ECM is provided with the conventional latches and drivers required to support the Input/Output functions; to drive motors, solenoids and alarms; and to process inputs from pressure transducers, temperature transducers, level transducers, speed transducers and digital inputs.

The electronic control module 42 is in signal receiving relation with a number of sensors that sense compressor operational parameters such as temperatures and pressures and supply the values to the ECM. Additionally, the ECM is preferably in signal transmitting relation with a number of the control valves, such as lubricant valve 36, and fan clutch 23 of compressor 10. The ECM also sends signals to the inlet valve motor 11. In FIG. 2, the communication link between the ECM and the respective sensors, valves and clutch is shown schematically in the form of a lead line with an arrowhead at one end of the lead line showing the direction of signal communication.

Referring to FIG. 2, the compressor control system 40 includes first, second, third, and fourth temperature sensors 44, 46, 48, and 49. First temperature sensor or "T1", is located between compression module discharge port 20 and separator 22 along flow line 24 and senses the temperature of the compressed fluid flowed out of the discharge port. The second temperature sensor or "T2" senses the temperature of the prime mover coolant that is circulated through the prime mover during operation thereof. The third temperature sensor or "T3" is located at the compression module inlet valve 26 and senses the temperature of the uncompressed fluid that is flowed into the compression module 12. The fourth temperature sensor or "T4" senses the temperature of the lubricant that is mixed with the fluid as the fluid is compressed in compression module 12.

The system 40 also includes two pressure sensors 50 and 52, and a prime mover speed sensor 54 identified respectively as "PT1", "PT2", and "S" in FIG. 2. The first pressure sensor 50 is located along flowline 24 proximate discharge port 20, and senses the pressure of the compressed gas discharged from the compression module 12. The second pressure sensor 52 senses the pressure of the prime mover lubricant. Speed sensor 54 is located on the prime mover and senses the rotational speed of the prime mover flywheel (not shown) during operation of the prime mover.

As shown schematically in FIG. 2, first, second, third, and fourth temperature sensors 44, 46, 48, and 49; first and second pressure sensors 50 and 52; and speed sensor 54 are electrically connected to the ECM 42, are in signal transmitting relation with the ECM, and send signals corresponding to the associated sensed compressor operating parameters to the ECM which processes the signals.

Figure 3:
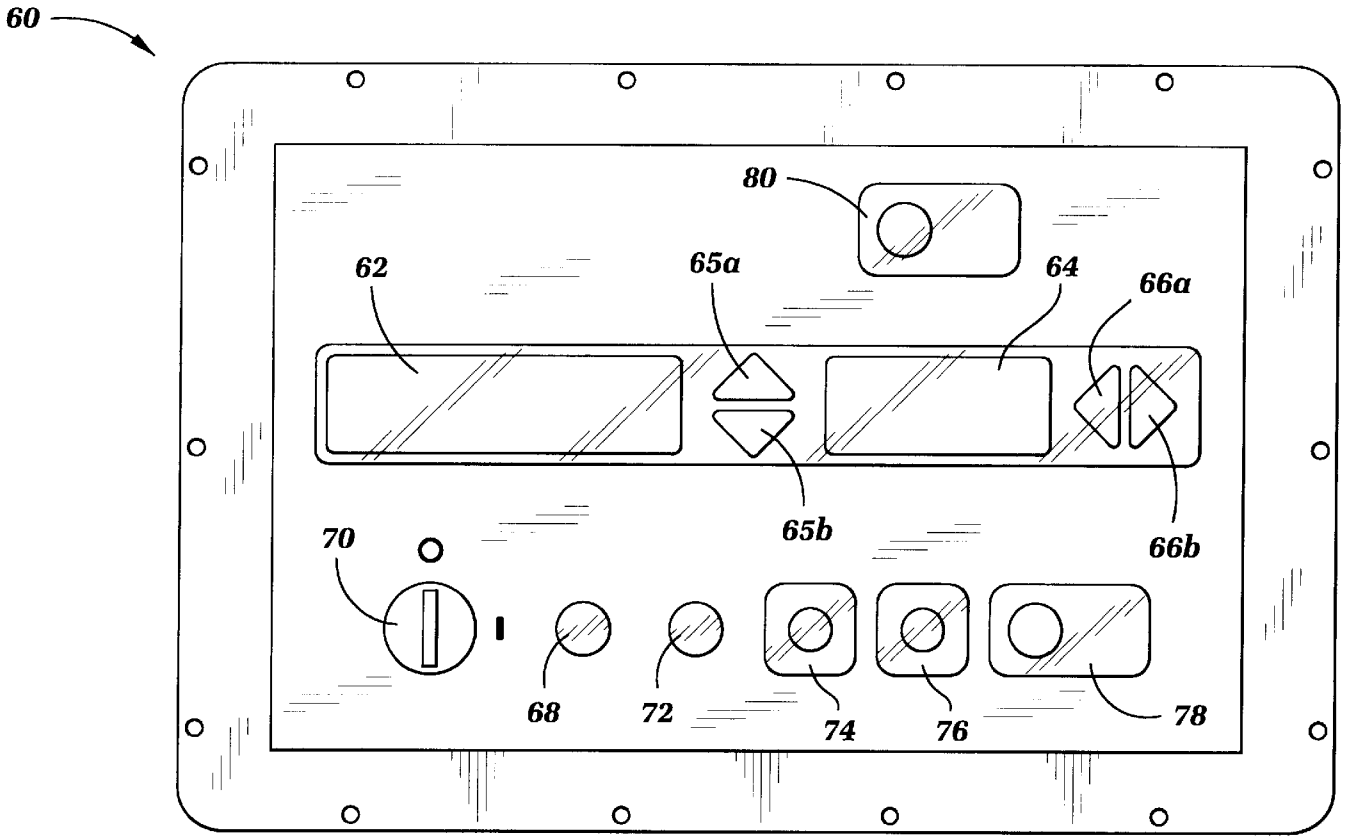
FIG. 3 shows a front view of a diagnostic control panel for the compressor of FIG. 1.

The ECM is electrically connected to compressor control panel 60 and receives signals from and sends signals to the panel. Instructions and messages transmitted from the ECM are displayed for viewing by a compressor operator in LCD alpha numeric format in display window 62, shown in FIG. 3. In response to the instructions and messages displayed in the window 62, the compressor operator can make the required changes to compressor operating parameters by entering set point parameter values in display window 64. Like window 62, the parameters are displayed in window 64 in a readable, LCD numeric format. The compressor operator can scroll through parameter menus that appear in the window 64 via up and down scroll keys 65*a* and 65*b*, can select a parameter value using select key 66*a*, and can return to a previous menu using return key 66*b*. Additionally, the return key 66*b* is used to store parameter set point values in the ECM memory 43*a*. For example, when a compressor parameter value is scrolled to using the scroll keys 65*a* and 65*b*, and modified from the menu, the value is stored in the ECM memory by actuating the return key 66*b*.

The panel 60 includes a compressor control system on/off switch 70 that supplies and terminates power to the ECM, sensors and diagnostic panel of system 40. Ether may be injected into prime mover 14 by actuating ether injection switch 72. The compressor is started and stopped by switches 74 and 76, respectively.

When compressor 10 is fully loaded, the "loaded" indicator 78 is illuminated indicating to the operator that the compressor is ready for use. Indicator 78 will be described below in conjunction with the description of the compressor load routine 140.

The ECM main logic routine includes an alert shutdown routine 400 for determining whether the compressor is running within undesirable parameters or whether the compressor is running at dangerous/hazardous levels. When a compressor operating parameter is outside an alert limit, hereinafter referred to as an "alert state", panel alarm indicator 80 is illuminated intermittently indicating to the operator that an alert state exists. In an alert state, the compressor continues to operate and a message is provided temporarily on display 62 notifying the operator of the nature of the alert state.

When a compressor operating parameter is outside a shutdown limit, hereinafter referred to as a "shutdown state", the alarm indicator 80 is continuously illuminated and a message describing the nature of the shutdown state is permanently displayed in window 62.

The display windows 62 and 64 may be backlit by lights and an externally located light may illuminate panel 60. When the compressor is operated in low lighting, the panel and displays may be illuminated by actuating light switch 68.

When the compressor is operated in direct sunlight or bright light, glare from the bright light on the display windows 62 and 64 is reduced by a coating applied to the display windows. The coating gives the display windows a darker, "smoked" appearance and eliminates the glare which would make reading the display windows difficult.

The control system on/off switch 70 is a conventional mechanical type switch, and the other panel switches are conventional membrane type switches all well known to one skilled in the art.

The Electronic Control Module (ECM)

The ECM is adapted for use with any suitable machine including but not limited to compressors, engines, and pumps for example.

The Electronic Control Module (ECM) is a microprocessor-based controller that efficiently controls operation of compressor 10. The ECM monitors actual values of operating parameters for the compressor, compares the actual operating parameter values with stored set point parameter values and relays signals for precisely controlling operating compressor components to ensure that the actual operating parameters are maintained within the range of the stored set point parameter values. FIGS. 4–14 illustrate the logic routine that is stored in the programmed ECM memory 43*a*. The logic includes the following routines: Main Control Routine 90 shown in FIG. 4; Prime Mover Start Routine 100 illustrated in FIG. 5; Fan Speed and Lubricant Volume Control Routine 120 shown in FIG. 6; Compressor Load Routine 140 shown in FIG. 7; 25 msec Interrupt Control Routine 150 illustrated in FIG. 8; Prime Mover Speed Control Routine 300 illustrated in FIG. 9; Discharge pressure control Routine 200 illustrated in FIGS. 10A and 10B; Alert/Shutdown Routine 400 illustrated in FIG. 11; Compressor Shutdown Routine 500 illustrated in FIG. 12; 5 msec Interrupt Control Routine illustrated in FIG. 13; and Actuator Position Control Routine 170 shown in FIG. 14. The subroutines 100, 120, 140, 150, 160, 170, 200, 300, 400, and 500 will be described in greater detail below.

In routine 90, initially when the control system is powered up, all of the system sensors and other hardware including switches and transducers are initialized in step 92 and at the conclusion of step 92, a message is displayed in control panel window 62 indicating to the compressor operator that the compressor is ready for use. During both initial prime mover startup and continuously during compressor operation, the routine 90 scans the control panel 60 in step 94 to determine if any control panel buttons have been pressed or operating parameter values have been inputted by the operator. See steps 94 and 96. After the routine determines the start button 74 has been pressed, the prime mover start routine 100 is executed.

Prime Mover Start Routine

Figure 5:
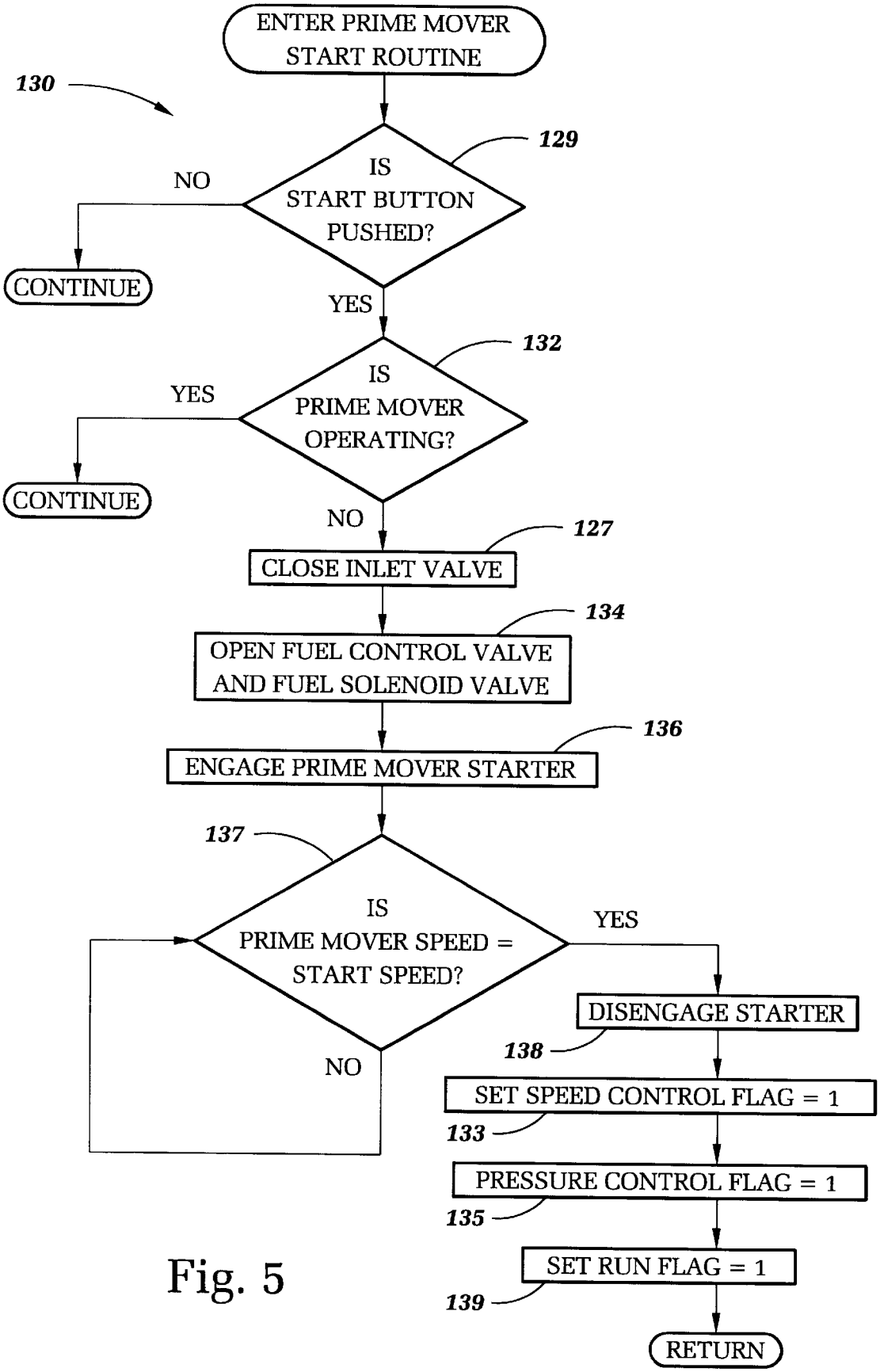
FIG. 5 shows a flowchart illustrating a prime mover start routine, identified in the flowchart of FIG. 4.

The prime mover start routine 100 is depicted in the flow chart shown in FIG. 5. Initially, in step 102 if the start button 74 on control panel 60 has been pushed and in step 104, if speed sensor 54 senses that prime mover 14 is not operating, in step 106, the inlet valve 26 is closed and in step 108 the fuel solenoid valve 35 and fuel control valve 29 are fully opened to permit fuel to be supplied to the prime mover from fuel supply reservoir 33. By fully opening valves 29 and 35, a maximum volume of fuel may be supplied to the prime mover during initial prime mover acceleration. The solenoid valve remains fully opened during compressor operation, and is closed when the compressor is shutdown. The position of the fuel control valve is controlled during operation. Closing the inlet valve prevents the compressor from being loaded until predetermined compressor loading operating conditions are realized.

In step 110, the prime mover is engaged by the prime mover starter (not shown) and once it is determined in step 112 that the prime mover is at a predetermined acceptable start speed, such as 600 rpm for example, the prime mover starter disengages the prime mover in step 114. Finally, in steps 116, 118 and 119 at the end of routine 100, a SPEED CONTROL FLAG, a PRESSURE CONTROL FLAG, and a RUN FLAG are each set equal to 1. By setting the SPEED CONTROL FLAG and PRESSURE CONTROL FLAG equal to 1, the prime mover speed control routine 300, and discharge pressure control routine 200 are executed during each 25 msec interrupt control loop 150. Prior to setting the SPEED CONTROL FLAG and PRESSURE CONTROL FLAG equal to 1, the routines 200 and 300 are not executed. Upon returning to routine 90, the compressor load routine 140 is automatically executed. There is no need for the operator to manually actuate the compressor load routine. Routine 90 executes the compressor load routine 140 automatically after the prime mover achieves start speed.

Fan Speed and Lubricant Volume Control Routine

Figure 6:
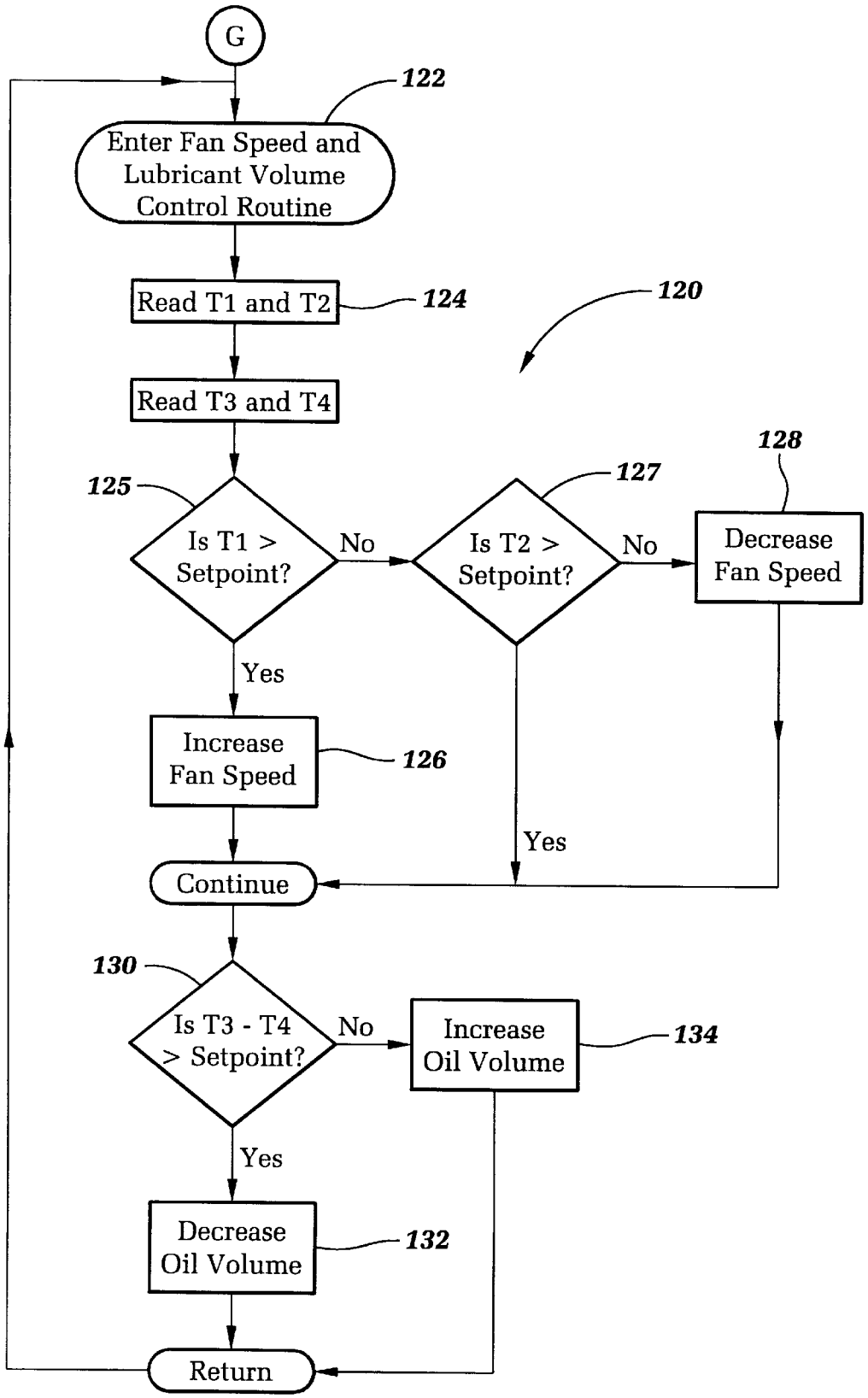
FIG. 6 shows a flowchart illustrating a fan speed and oil volume control routine, identified in the flowchart of FIG. 4.

The Logic Routine 90 includes a Fan Speed and Lubricant Volume Control Routine 120 illustrated in FIG. 6. The Fan Speed and Lubricant Volume Control Routine 120 increases the efficiency of the compressor 10 by precisely regulating the temperatures of the compression module 12 and the prime mover 14. This is achieved by supplying a precise volume of cooling air to the interior components of the compressor and by regulating the amount of lubricant, such as oil, supplied to a compression module. Although the present invention is not limited by any particular theory of operation, it has been shown that if the temperature of the compression module 12 and the prime mover 14 are maintained substantially constant at a predetermined temperature during operation of the compressor 10 that the fluid being compressed therein will flow more evenly through the compressor, thereby improving the performance of the compressor.

Referring to FIG. 6, after entering the Fan Speed and Lubricant Volume Control Routine 120 at step 122, the actual values of the compression module discharge temperature, T1; prime mover coolant temperature, T2; compression module inlet temperature, T3; and compression module lubricant temperature, T4 are read in step 124.

In Routine step 125, the actual compression module discharge temperature T1 is compared to the set point parameter value of the preferred compression module discharge temperature stored in the ECM memory 43. If the actual compression module discharge temperature T1 is greater than the set point parameter value of the preferred compression module discharge temperature, the speed of prime mover fan 21 is increased in step 126. The actual magnitude of the increase is based upon empirical data stored in the ECM memory.

If the actual compression module discharge temperature T1 is not greater than the set point parameter value of the preferred compression module discharge temperature, then the routine in step 127 determines whether the actual prime mover coolant temperature T2 is greater than the set point parameter value of the preferred prime mover coolant temperature stored in ECM memory 43. If the actual prime mover coolant temperature is greater than the set point parameter value of the prime mover coolant temperature, the speed of prime mover fan 21 is decreased in routine step 128. The actual magnitude of the decrease is based upon empirical data stored in the ECM memory.

As mentioned above, in routine steps 126 and 128, the actual magnitude of the increase or decrease in the prime mover fan speed is determined through data stored in the ECM memory. The data is preferably compiled during empirical testing of a particular compressor. In other words, each particular model of a compressor will preferably have its own unique set of empirical data. After testing, the data is stored in the ECM memory. The data is accessed during execution of routine 120 to determine the magnitude of the change in fan speed. By increasing or decreasing the speed of the fan, the ambient air that is drawn into the compressor in the direction identified by arrows 17 in FIG. 2 is increased or decreased. As the volume of ambient air drawn into the compressor increases, the temperature of the prime mover and compression module decreases. In contrast, as the volume of ambient air drawn into the compressor decreases, the temperature of the prime mover and compression module increases. As a result, the temperature of the prime mover and compression module may be maintained at a constant level so that the viscosity of the fluids passing through the prime mover and compression module remains even. As such, efficient flow of the fluid and efficient operation of the compressor may be achieved.

After the ECM reads the data stored in the ECM memory to determine the required magnitude of the increase or decrease in fan speed, the ECM generates a signal that is transmitted to the fan clutch 23. In response to receiving this signal, the fan clutch is adjusted to increase or decrease the speed of fan 21 as required.

In certain preferred embodiments, when the ambient temperature surrounding the compressor 10 is above a certain extreme value the fan will preferably run continuously. For example, when the ambient temperature is at or above 80 F., T1 and T2 will likely be above the stored set point parameter values and the fan will run continuously.

During step 130 the routine 120 computes the difference between the temperature of the uncompressed fluid T3 introduced into the compression module and the temperature of the lubricant T4 mixed with the fluid in the compression module. The routine computes the difference by subtracting the lubricant temperature T4 from the compression module inlet temperature T3 to provide what is hereinafter referred to as the "actual temperature differential" or "AΔT". If the actual temperature differential is above or below a predetermined set point differential or target temperature differential hereinafter referred to as either the "set point temperature differential" or "TΔT", the Routine 120 adjusts the volume of lubricant supplied to the compression module 12 to produce an actual temperature differential or AΔT, equal to the predetermined target temperature differential or TΔT. A typical set point temperature differential value for compressor 10 is 60 F., produced by a sensed inlet fluid temperature of 210 F. and a compressor lubricant temperature of 150 F.

If the AΔT is equal to the TΔT, the volume of lubricant introduced into the compression module 12 does not change and Routine 120 returns to the Sensor Scan Routine 150. However, if in decision block 130 it is determined that the AΔT is greater than the TΔT set point, the flow rate of lubricant to the compression module through lubricant valve 36 is increased at step 132. Conversely, if in decision block 130 it is determined that the AΔT is below the TΔT set point, the flow rate of lubricant to the compression module is decreased at step 134. In a similar fashion to the fan speed subroutine, the amount that the lubricant volume must be increased or decreased to achieve the predetermined acceptable set point TΔT is determined empirically and that empirical data is stored in ECM memory 43, the empirical data being accessed during the Fan Speed and Lubricant Volume Control Routine 120.

In certain preferred embodiments, the prime mover coolant temperature T2 is compared with a stored maximum prime mover coolant temperature stored in the ECM memory 43 to determine whether any adjustment to the speed of the fan 21 will negatively affect the temperature of the engine coolant. In this way, the efficiency of the prime mover 14 is not sacrificed in order to obtain the desired TΔT.

The Fan Speed and Lubricant Volume Control Routine 120 is preferably complete sequentially with the Fan Speed subroutine preceding the Lubricant Volume control subroutine.

The Routine then returns to Sensor Scan Routine 150 which, in turn, returns to the main routine 90.

Compressor Load Routine

Figure 7:
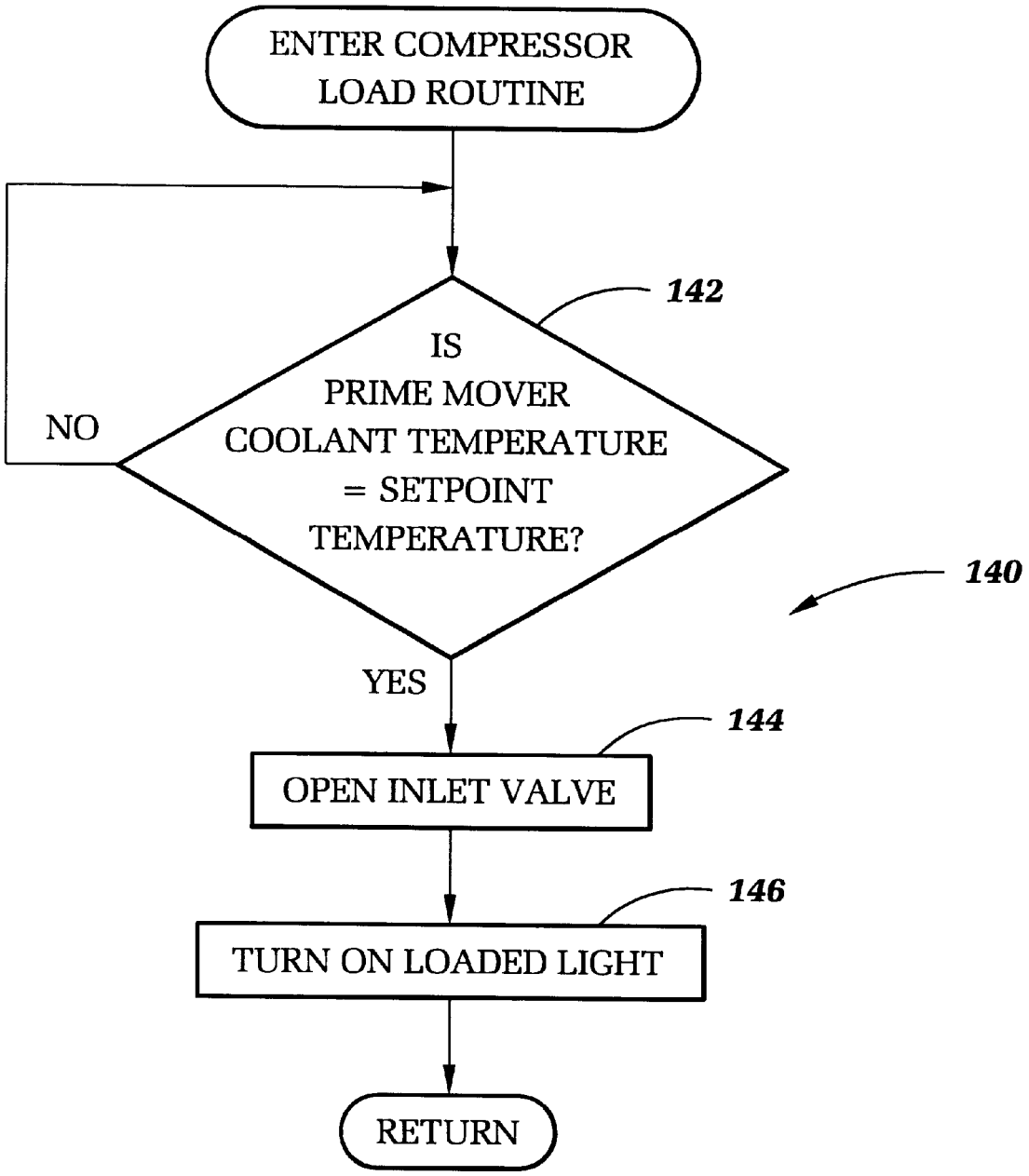
FIG. 7 shows a flowchart illustrating a compressor load routine, identified as step 140 in the flowchart of FIG. 4.

The Compressor Load Routine 140 is depicted in the flow chart shown in FIG. 7. When the routine 90 enters the compressor load routine, the prime mover 14 is turning at idle speed (1200 rpm). In step 142, the prime mover maintains the idle speed as the temperature of the prime mover coolant sensed by temperature sensor 46 increases to the set point coolant temperature. The set point coolant temperature may be 90 F. for example. The routine 140 will not proceed past step 142 until the prime mover coolant temperature reaches the predetermined set point temperature stored in memory 43*a*. When the coolant temperature reaches the predetermined set point temperature in step 142, the ECM sends a signal to compressor inlet valve 26 and thereby opens the inlet valve, in step 144. After the inlet valve is opened and the compressor is at least substantially loaded to achieve the desired discharge pressure, step 146 is executed and the loaded light 78 on the control panel 60 is illuminated by the ECM.

Therefore, as a result of the compressor load routine 140, the compressor is loaded automatically after both the prime mover coolant temperature sensed by sensor 46, and prime mover speed sensed by sensor 54 are at predetermined set point values.

25 msec Interrupt Control Routine

Figure 8:
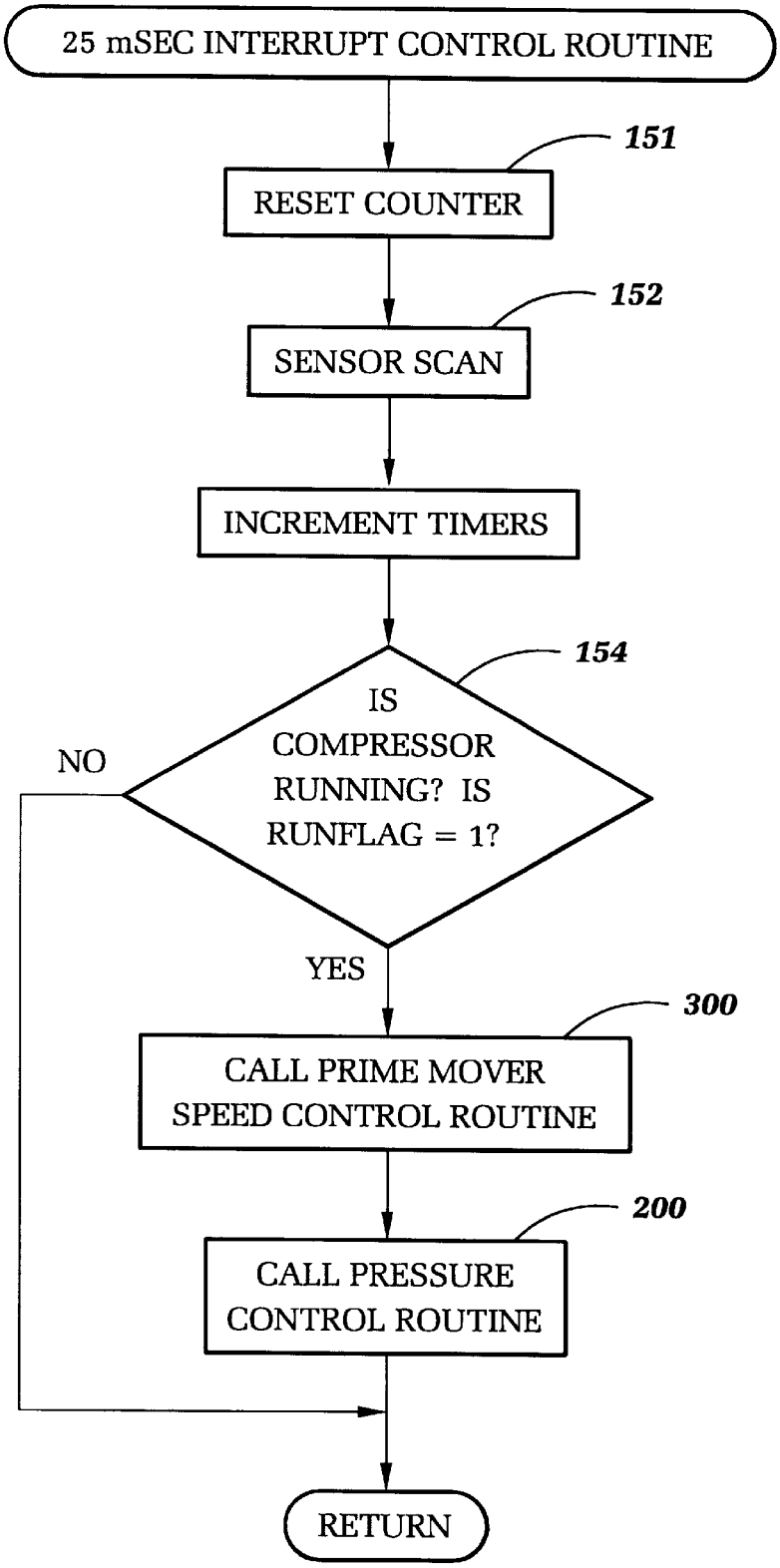
FIG. 8 shows a flowchart illustrating the twenty-five millisecond interrupt control routine, identified as step 150 in the flowchart of FIG. 4.

Execution of main routine 90 is interrupted every twenty-five msec, at the expiration of interrupt counter 45, to execute interrupt control routine 150, flowcharted in FIG. 8. The routine 150 is represented in dashed font in FIG. 4 since the routine may be initiated at any point along the routine 90.

After resetting the counter in step 151 and scanning the sensors, switches and transducers in step 152, the routine determines whether the compressor is running by reading the value of RUN FLAG in step 154. If the compressor is not running, the routine 150 returns to routine 90. If the RUN FLAG value is 1, the compressor is running, and the routine then runs prime mover speed control routine 300 flowcharted in FIG. 9, and discharge pressure control routine 200 flowcharted in FIGS. 10A and 10B. As indicated hereinabove, routines 200 and 300 are only run if the associated FLAGS have been set to 1. After the routines 200 and 300 have been run the routine 150 returns to main routine 90.

Referring to FIG. 8, the sensor scan step 152 is initiated, temperature sensors 44, 46, 48, and 49; and pressure sensors 50 and 52 (designated as PT1 and PT2 in FIG. 2) are scanned and the actual compressor operating values sensed by the sensors are obtained and are stored in the ECM memory 43*b*.

The sensor scan routine 152 calculates a running average of the discharge pressure PT1 and the average slope of the discharge pressure PT1, where the slope is equal to the change in compressor discharge pressure per unit time. A numerical filtering technique, such as the least squares fit or a Butterworth filter is used to obtain the slope. The filtering technique is necessary because of the pressure pulsations that result from operation of a screw compressor.

The routine 150 is initiated every twenty-five msec, however, it should be understood that the frequency of the interrupt control routine may be increased or decreased, as necessary.

Prime Mover Speed Control Routine

Figure 9:
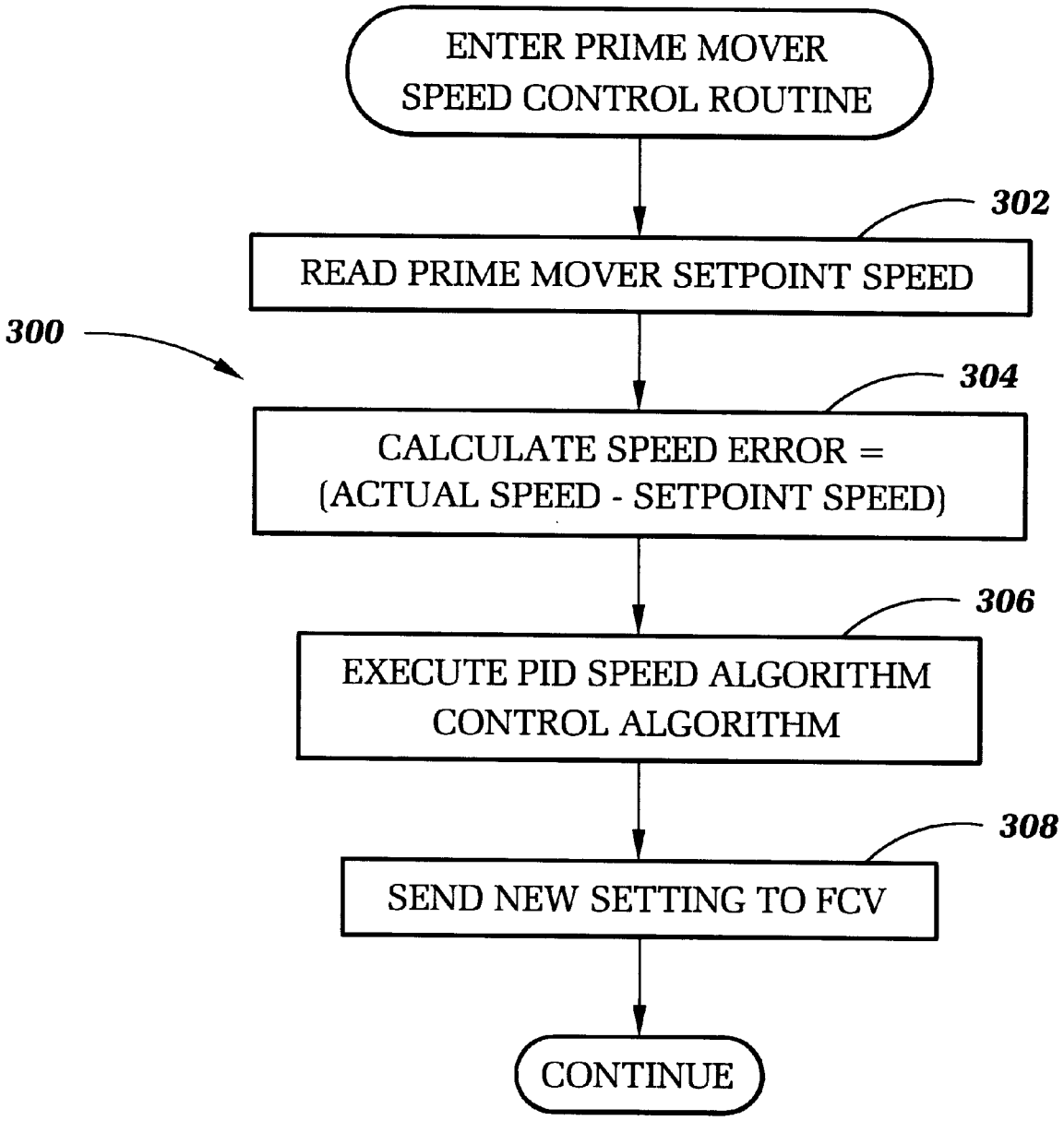
FIG. 9 shows a flowchart illustrating the prime mover speed control routine, identified as step 300 in the interrupt control routine of FIG. 8.

Referring to FIG. 9, the prime mover speed control routine 300 is executed when the SPEED CONTROL FLAG (step 116 of Prime Mover Start Routine 100) is set equal to 1. The rotational speed of the prime mover 14 is monitored by routine 300. The routine adjusts the speed of the prime mover to counteract the variable compression module loads by adjusting the volume of fuel supplied to the prime mover through the fuel valve 29. In this way, the speed of the prime mover is not affected by the changing compression module loads. The prime mover speed control routine 300 causes the speed of the prime mover to be maintained when the prime mover speed would be otherwise increased or decreased due to fluctuations in the loading of the compression module 12.

The prime mover speed is sensed using a magnetic pickup that sends a pulse signal to the ECM with each passing of a tooth on the flywheel ring gear. The routine uses the ECM crystal oscillation frequency to calculate the time period between pulses, and uses this information to calculate the speed of the prime mover. Since the speed of an internal combustion engine is oscillatory, due to torque pulses each time the engine fires, the prime mover speed is averaged over a predetermined number of tooth passings, 29 for example.

Initially in step 302, the prime mover set point speed stored in ECM memory 43*a*is read by the routine 300, and in step 304, the speed error is calculated by subtracting the set point speed from the actual speed value sensed by speed sensor 54 shown in FIG. 2.

The calculated speed error is then used in step 306 to execute a conventional proportional integral derivative ("PID") algorithm. The PID algorithm determines the fuel control valve setting required to obtain the prime mover set point speed. The PID could utilize either the absolute setting or incremental setting routines to determine the required FCV setting. However, it is preferred that the absolute setting routine be used so that a fuel control valve setting is calculated each time Routine 300 is executed.

In step 308, after the PID algorithm is executed and the new valve setting is calculated, a repositioning signal is sent to fuel control valve 29. As a result, the fuel control valve 29 is precisely repositioned so that the prime mover speed is within the predetermined set point parameter speed. The new set point speed is stored in ECM memory 43.

Routine 300 then returns to interrupt control routine 150.

Discharge Pressure Control Routine

Figure 10A:
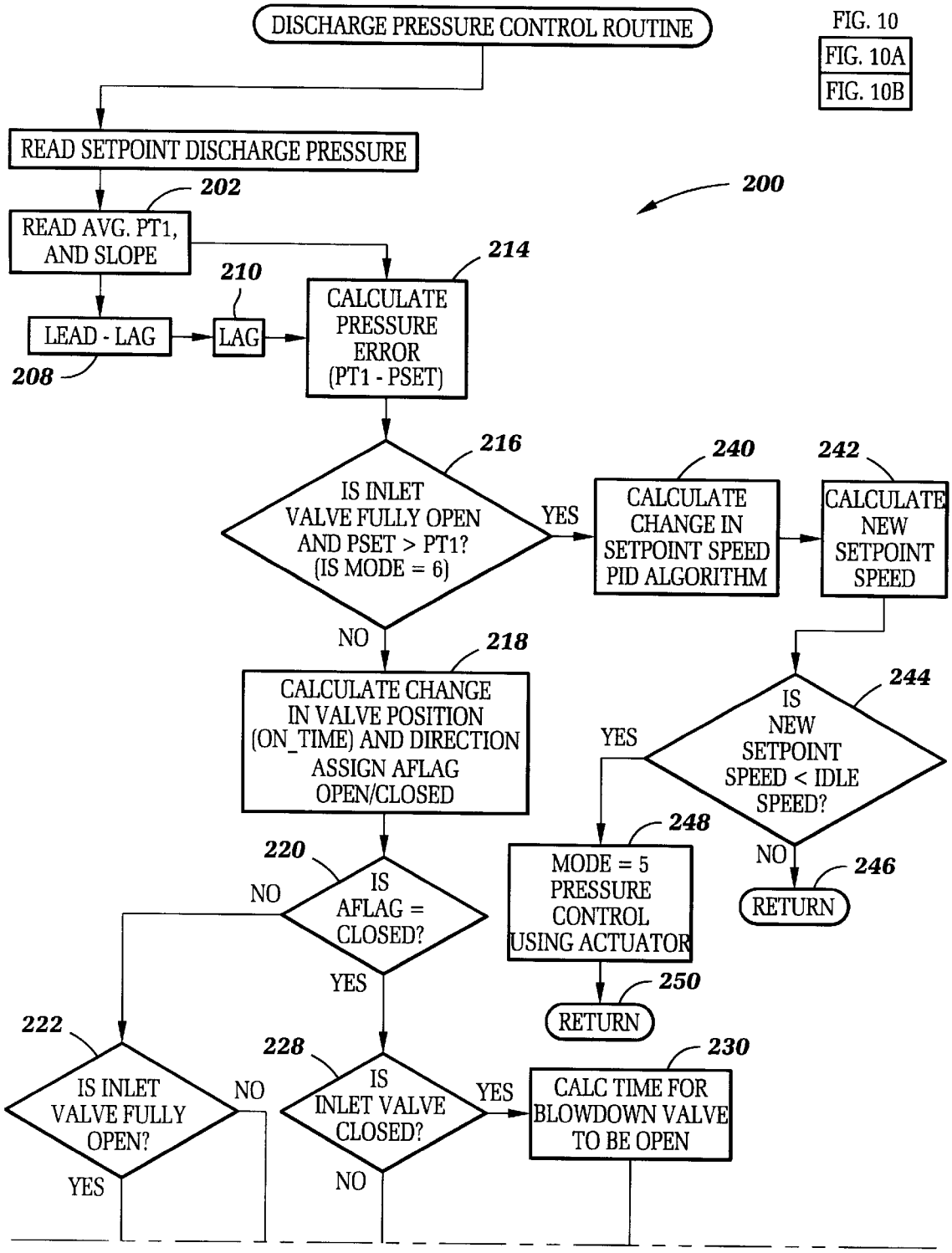
FIGS. 10A and 10B show a flowchart illustrating the discharge pressure control routine, identified as step 200 in the interrupt control routine of FIG. 8.
Figure 10B:
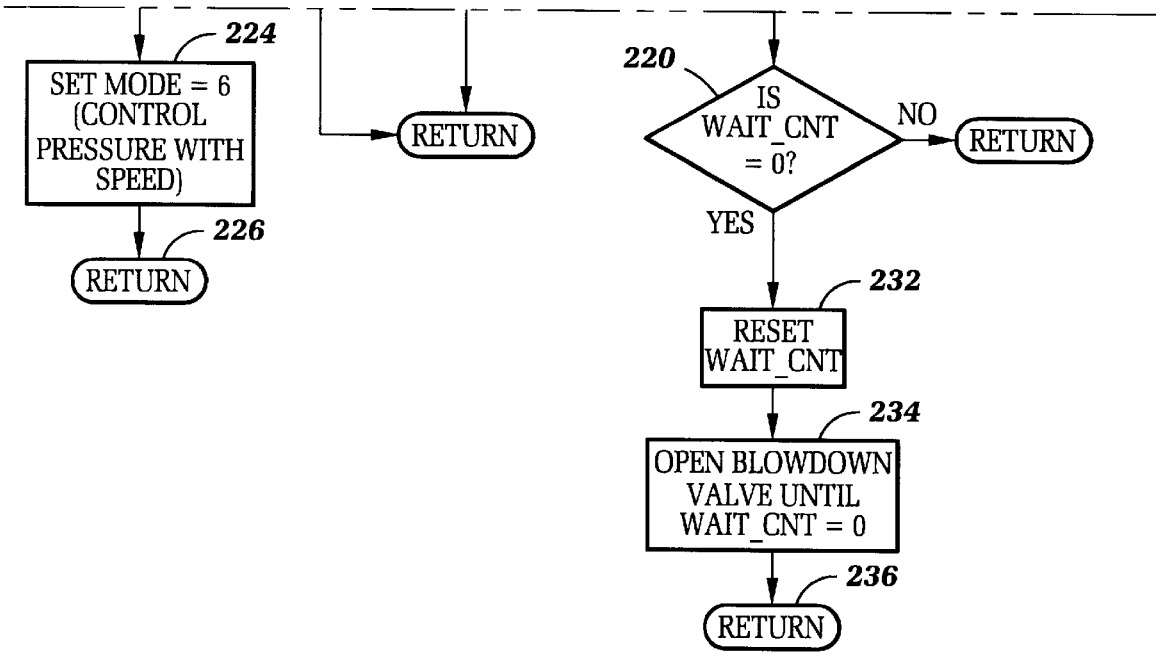

Discharge pressure control routine 200 is illustrated in FIGS. 10A and 10B and allows for independent control of the prime mover 14 set point speed, and positioning of the inlet valve 26, in order to effect the actual discharge pressure of the compressor 10.

In conventional compressors, the speed of the prime mover and position of the inlet valve are linked together. The inlet valve position and prime mover speed are adjusted together to produce the required set point discharge pressure. This dependency can limit a compressor operator's ability to produce the required discharge pressure.

Now turning to the flowchart shown in FIGS. 10A and 10B showing a discharge pressure control routine identified generally at 200, the discharge pressure control routine serves to control discharge pressure by either repositioning the position of the inlet valve or by changing the speed of the prime mover.

Initially, in steps 202 and 204, the measured average discharge pressure, PT1; slope, PT1SLOPE; and the set point discharge pressure are read from the controller memory 43*a*. The measured average discharge pressure and slope are stored in memory during the sensor scan routine 152 and the set point discharge pressure is stored in memory via operator input at the control panel 60.

Then in step 208 a lead-lag routine is executed. Lead-lag routines are well known to one skilled in the art. The lead-lag routine improves response of the control system. In step 210, a conventional lag routine is executed, in order to ramp the set point pressure.

In step 214, the discharge pressure error is computed by subtracting the measured average discharge pressure, PT1, from the set point pressure, PSET. If the discharge pressure is not equal to the set point pressure or within an acceptable deadband range, ±1 psi for example, and the inlet valve 26 is not fully open, the control routine will produce the required discharge pressure by repositioning the inlet valve. Otherwise, the routine will effect the discharge pressure by changing the speed of the prime mover. See step 216.

In step 218, the required change in valve position and direction of change (open or close) are computed using the following proportional integral derivative ("PID") algorithm:

$$\text{valve position}=D*\text{Perr}+E*\text{PT1SLOPE}$$

where D and E are constants, the values of which are determined empirically; and Perr=pressure error computed as (actual pressure−set point pressure).

The value of "valve position" has a magnitude and positive or negative sign convention indicating the direction the valve needs to be moved to produce the required set point discharge pressure. For example, a positive sign convention may indicate the valve needs to be opened while a negative sign convention means the valve needs to be closed.

In step 218, based on the positive or negative sign of valve position, a directional flag referred to as AFLAG is set equal to "open" or "closed". The AFLAG value is used to drive the actuator motor in the required direction in routine 170.

Also in step 218, a variable ON_TIME is assigned a value that corresponds to the amount of time the linear actuator motor 11 must be energized in order to move the valve the required distance equal to "valve position".

In step 220, if it is determined the valve needs to be opened to increase discharge pressure (AFLAG=open), and if in step 222 it is determined that the inlet valve 26 is fully open, the program mode is set to 6 and the discharge pressure is altered by changing the prime mover set point speed the next time the speed control routine 300 is executed. The routine then returns to the interrupt control routine 150 in step 226.

Returning now to step 222, if the valve needs to be opened and the valve is not fully open, the valve is opened by energizing the motor, in the required direction, for a period equal to ON_TIME. This method will be further described in conjunction with routines 160 and 170.

Returning to step 220, if it is necessary to close the inlet valve in step 220, and the inlet valve is not already fully closed, the inlet valve is repositioned by energizing the actuator motor, in the required closed direction, for a period equal to ON_TIME. This method will be further described in conjunction with routines 160 and 170.

If the valve is already fully closed, the controller will open the blowdown valve 39 for a predetermined period of time calculated in step 230. After the blowdown valve is closed, the system allows the compressor to settle by waiting for the counter WAIT_CNT to zero out. In step 232, before opening the blowdown valve, the WAIT_CNT is reset to a predetermined value. Then in step 234, the blowdown valve is opened and closed and the system does not reopen the blowdown valve until the WAIT_CNT zeros out.

Returning to decision block 216, if the inlet valve is fully open and the set point pressure is different from the measured discharge pressure, the control routine will produce the required discharge pressure by changing the prime mover set point speed.

In step 240, the change in the set point speed is computed by as follows:

$$\text{set point speed}=A*\text{Perr}+B*\text{PT1SLOPE}$$

where Perr and PT1SLOPE are as previously defined hereinabove and A and B are empirically determined constants.

Then the new set point speed is calculated in step 242 by adding or subtracting the value obtained in step 240 to the current set point speed stored in memory. The new set point speed value is then stored in memory and is compared to the idle speed for the compressor. See step 244. If the idle speed is less than the new set point speed, the routine returns directly to the 25 msec interrupt control routine.

If the new set point speed is less than the idle speed, the routine sets the operating mode equal to 5 which corresponds to a condition whereby discharge pressure is controlled by repositioning the valve. The routine then returns to the interrupt routine 150 in step 250. The next time the routine 200 is executed and executes decision block 216, the mode will be equal to 5 and the system will proceed directly to block 218.

5 msec Interrupt Control Routine

Referring to FIGS. 13 and 14, 5 msec Interrupt Control Routine 160 is executed every 5 msec regardless of the location in routine 90. This particular routine is similar to the 25 msec Interrupt Control Routine 150 that occurs every 25 msec regardless of the location of the routine 90.

At step 162 thereof, the 5 msec Interrupt Routine 160 calls Actuator Position Control Routine 170, shown in FIG. 14. The routine 170 includes a hardware driver routine that drives the motor for the actuator that opens and closes the inlet valve 26. The Actuator Position Control Routine 170 repositions the inlet valve based on the values of ON_TIME and AFLAG received from the Discharge Pressure Control Routine 200 (FIGS. 10A and 10B). All decisions regarding direction and energizing time are made in the Discharge Pressure Control Routine 200. The routine energizes the actuator motor for 5 msec intervals until the actuator motor has been energized for ON_TIME. When the routine 170 is executed, SECNT is set equal to ON_TIME. The SECNT is decremented in step 166 of routine 160 each time the 5 msec interrupt is executed, until the SECNT is equal to zero.

Now turning to routine 170, in FIG. 14, the value of AFLAG is determined in decision blocks 172, 174, 176, and 178 which determine if the AFLAG is equal to open, closed, brake or stop. AFLAG is set equal to brake after the actuator motor has been energized for a period equal to ON_TIME. AFLAG is set equal to stop when a repositioning is finished. If AFLAG is equal to stop, the actuator motor is turned off in step 198.

If AFLAG is equal to open, and if SECNT is not equal to zero, the actuator motor is energized for the 5 msec duration of routine 170. The routine 170 returns to routine 90 at the end of 5 msec in step 184. This branch of the routine 170 is repeated until SECNT is decremented to zero. When SECNT is zero, AFLAG is set equal to brake and SECNT is set equal to a braking interval, 25 milliseconds for example. Then, when the routine 170 reaches decision block 176 a braking pulse is transmitted to the motor in step 190. The braking pulse is equal in magnitude and opposite in direction to the ON_TIME energizing pulse. The braking pulse is sent to the motor until SECNT runs down to zero.

The braking pulse time interval is not equal in duration to the ON_TIME energizing pulse time interval. For example, if the ON_TIME energizing pulse has a magnitude of 24 v and lasts for a total of 25 msec, the braking pulse would be −24 volts and may have a duration of 5 or 10 msec. The braking pulse counteracts the momentum of the motor and thereby effectively and precisely brakes the motor. This pulsation method of repositioning the valve is distinguishable from movement by conventional stepper motors.

After the motor is braked, AFLAG is set equal to stop and the system pauses for an empirically determined period of time referred to as "system dead time", step 193. A conventional counter in the logic routine counts down the system dead time. During the system dead time, which varies based on the discharge capacity of the compressor, the compressor is given a chance to "settle" and adjust to the new compressor valve setting before changing the valve position again. Once the system dead time has expired, the routine returns to routine 90.

If AFLAG is equal to closed, the motor is energized and braked in the manner previously described in conjunction with opening the valve. The closing steps are identified as steps 192, 194, and 196.

Alert/Shutdown Routine

Figure 11:
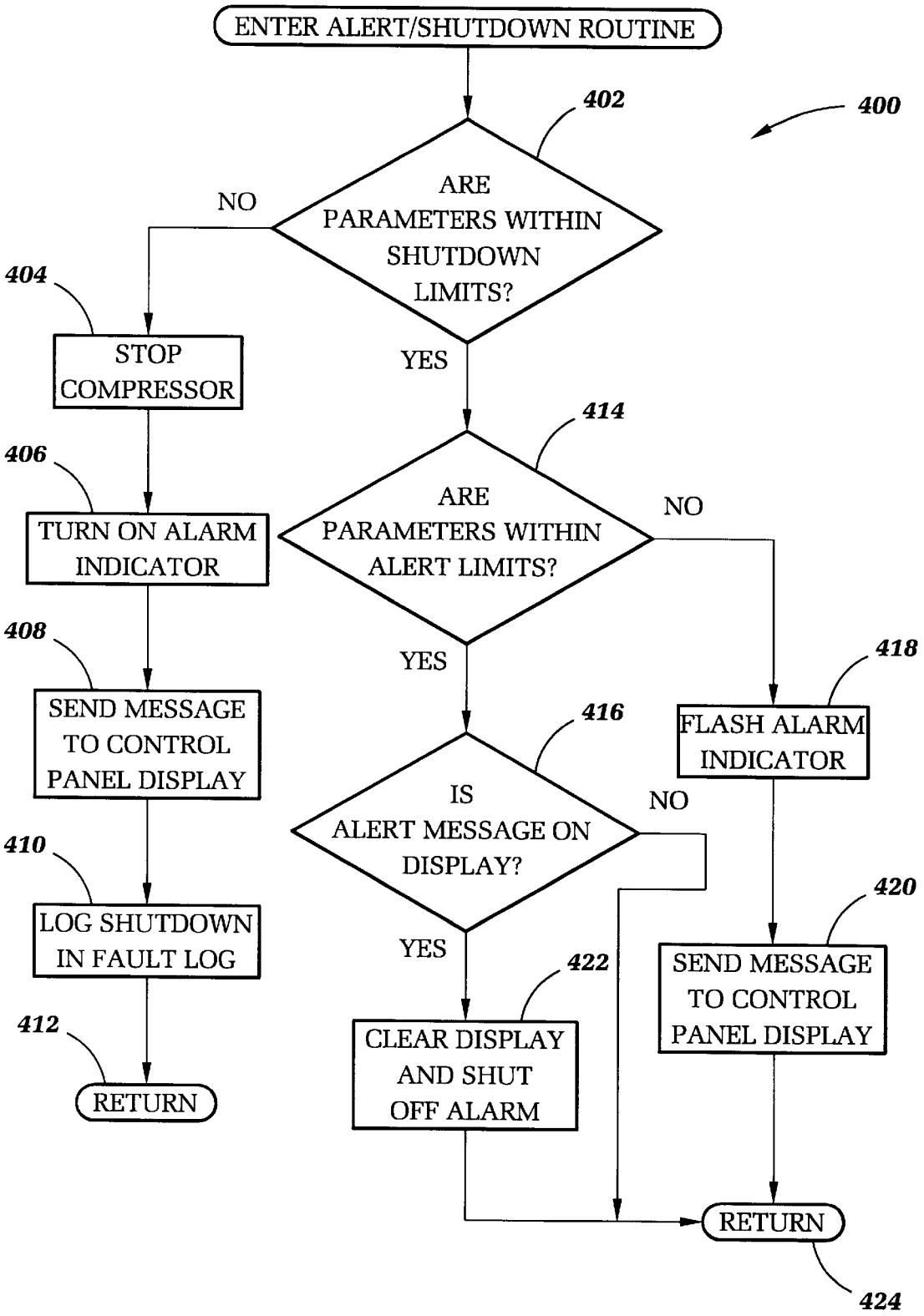
FIG. 11 shows a flowchart illustrating the alert/shutdown routine, identified as step 400 in the flowchart of FIG. 4.

The compressor control system preferably includes an alert/shutdown routine generally referred to at 400 in FIG. 11. Generally, in the alert/shutdown routine, a number of the compressor operating parameters are compared with predetermined alert and shutdown limits and if the parameters are outside the alert and shutdown limits, the operator will be alerted of a problem or the compressor will be shutdown. The parameters analyzed during alert/shutdown module 400 are compression module discharge pressure, discharge temperature, prime mover speed, prime mover coolant temperature, compression module lubricant temperature, and prime mover lubricant pressure. For purposes of describing the preferred embodiment, only the compression module discharge temperature and prime mover coolant temperature have alert and shutdown limits. The balance of the parameters only operate under shutdown limits. However, these parameters may also operate with associated alert limits if required.

In step 402 of routine 400, the sensed values for the operating parameters associated with each sensor that were stored in ECM memory in the scan sensors step of interrupt control routine 150 are compared with shutdown limits for the parameters. If the parameters are not outside of the shutdown limits, the routine proceeds to step 414.

If one of the operating parameters is outside its respective shutdown limit, the compressor is shutdown in step 404 by shutdown routine 500. The compressor is shutdown when either the actual prime mover speed or prime mover lubricant pressure is higher or lower than the shutdown limits, and the compressor is shutdown when either the discharge temperature, compressor lubricant temperature or engine coolant temperature is only above the shutdown limits. For these parameters, the compressor does not shutdown when the parameters are below the shutdown limits.

When the compressor is shutdown, the display panel alarm indicator 80 is illuminated in step 406 and remains continuously illuminated until the shutdown condition is corrected. Additionally, in step 408 a message is displayed in display window 62 describing the shutdown condition. The message remains displayed in window 62 until the shutdown condition is corrected.

In step 410, the shutdown condition is logged in the ECM fault log and is stored in the ECM memory. The routine 400 then returns to the main program in step 412.

If none of the parameters are outside the shutdown limits the module proceeds to step 414. In step 414, the sensed values for the compression module lubricant and prime mover coolant temperatures by sensors 49 and 46 are compared with associated temperature alert limits. If the actual temperatures are within the alert limits and there is not a message on the panel display, the module returns to main routine 90. However, if the temperatures are outside the alert limits, the display panel alarm indicator 80 is illuminated intermittently in step 418, to attract the attention of the compressor operator and, in step 420 a message is displayed in window 62 indicating the nature of the alert condition.

If, after an alert condition occurs, the sensed valves return to a state within the alert limits, the alarm indicator stops flashing and the message is removed from the display window in step 422. The routine 400 then returns to the main routine in step 424.

In addition to the coolant temperature and lubricant temperature, battery voltage and fuel level may also be monitored by the alert/shutdown routine. As the fuel level and battery voltage fall to levels outside of the respective alert limits, the compressor operator would be alerted of the condition in the manner previously described.

Compressor Shutdown Routine

Figure 12:
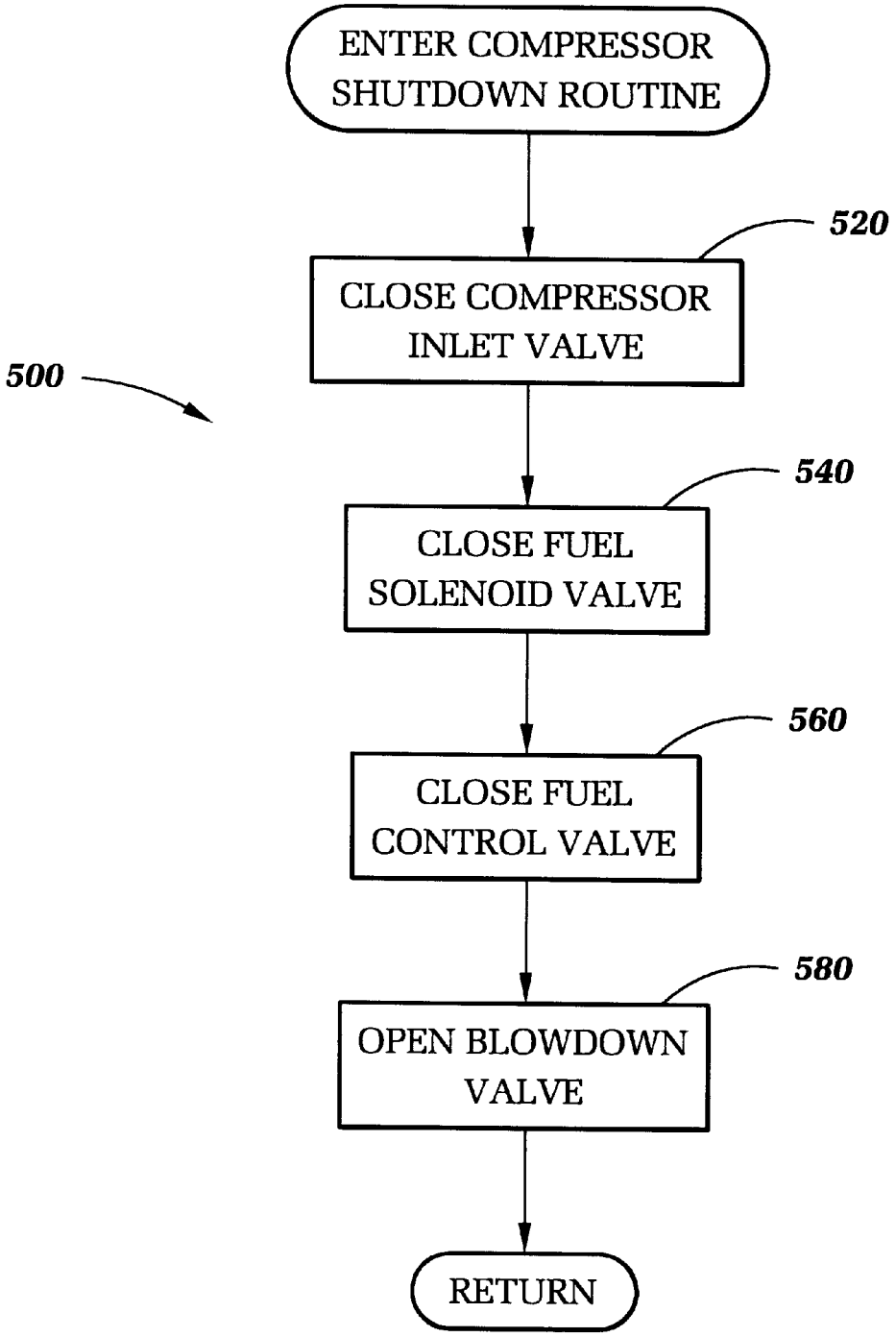
FIG. 12 shows a flowchart illustrating the compressor shutdown routine, identified as step 500 in the flowchart of FIG. 4.

Referring to FIG. 12, the Compressor Shutdown Routine 50 is executed when it is necessary to shutdown the compressor either due to a sensed shutdown state or because the Stop button 76 (FIG. 3) has been actuated by the compressor operator. The compressor shutdown routine is generally comprised of steps 520, 540, 560, and 580. In step 520, sending a signal from the ECM to the inlet valve actuator closes the compressor inlet valve 26. Then in steps 540 and 560 respectively the fuel solenoid valve 35 and fuel control valve 29 are closed. Finally in step 580, the blowdown valve 39 is opened.

In each of the steps of routine 500, the ECM sends a signal to the solenoid or switch associated with the valve and thereby opens or closes the respective valve.

Ether Injection

At low ambient temperatures, the compressor prime mover 14 can be difficult to start. In such ambient conditions, the ether button 72 on control panel 60 may be pressed to open the ether valve 25 to flow a discrete volume of ether from tank 27 into the prime mover and thereby help to start the prime mover. Each time button 72 is actuated, the ether valve is opened and a fixed volume of ether is released into the prime mover.

However in order to prevent injection of an excess volume of ether into prime mover 14, the ECM monitors the release of ether into the prime mover and will only permit a predetermined number of dispensations of ether into the prime mover per unit time. For example, the ECM may be programmed so that ether may only be injected into the prime mover 10 times in any 60-second period. Once this maximum is reached, the ECM disables the ether button preventing further the release of ether into the prime mover. After a predetermined period of time expires, the button is again enabled and ether may again be injected into the prime mover.

Antirumble Valve

During operation of the compressor 10 when the compressor is operating at idle speed (1200 rpm) and the inlet valve 26 is substantially closed so that the compressor is substantially unloaded, the ECM 42 actuates the antirumble valve 28 so that fluid flowed out compressor 12 is recirculated through conduit 15 and ARV 28 back into the compressor. In this way, vibration of the rotors frequently present at high inlet vacuum and reduced compressor load, known to those skilled in the art as Arumble@ is eliminated.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What is claimed is:

1. A method for optimizing the operating efficiency of a compressor having a compression module for compressing a fluid, the compression module including an inlet for receiving the fluid and an outlet for discharging compressed fluid, the compressor including a prime mover for driving the compression module and a rotatable fan for drawing ambient air into the compressor, the compressor including a first temperature sensor for sensing the temperature of compressed fluid discharged from the compression module, a second temperature sensor for sensing the temperature of a coolant circulating through the prime mover, a third temperature sensor for sensing the temperature of the fluid entering the compression module, and a fourth temperature sensor for sensing the temperature of a lubricant mixed with the fluid as the fluid is compressed in said compression module, the compressor including an electronic control module (ECM) electrically connected to the temperature sensors for receiving signals therefrom, the ECM including a non-volatile memory containing empirical data relating to optimal operating set points of the compressor and a logic routine for controlling the rotational speed of the fan and the volume of the lubricant mixed with the fluid so as to optimize the efficiency of the compressor, the method comprising the steps of:

A) executing a temperature sensing subroutine whereby the first, second, third and fourth temperature sensors collect temperature data during operation of the compressor and relay the temperature data to the ECM;

B) executing a fan speed subroutine whereby the ECM generates signals in response to the temperature data received for controlling the rotational speed of the fan; and C) executing a lubricant volume control subroutine whereby the ECM generates signals in response to the temperature data received for controlling the volume of the lubricant mixed with the fluid during compression of the fluid in the compression module.

2. The method as claimed in claim 1, wherein the compressor module has an outlet for discharging the compressed fluid and the first temperature sensor is in communication with the compressed fluid at the outlet of the compressor module.

3. The method as claimed in claim 1, wherein the compression module has an inlet for introducing the fluid into the compression module and the third temperature sensor is in communication with the fluid at the inlet of the compression module.

4. The method as claimed in claim 1, wherein the ECM logic routine for controlling the fan speed and the lubricant volume is continuously repeated during operation of the compressor for maintaining the prime mover and the compression module within an optimum temperature range.

5. The method as claimed in claim 4, wherein the ECM logic routine is repeated at least approximately every 20–30 milliseconds.

6. The method as claimed in claim 5, wherein the ECM logic routine is repeated at least approximately every 8–12 milliseconds.

7. The method as claimed in claim 1, wherein the step of executing a temperature sensing subroutine includes the steps of:

(i) sensing the actual temperature of the compressed fluid discharged from the outlet of the compression module;

(ii) sensing the actual temperature of the coolant circulating through the prime mover;

(iii) sensing the actual temperature of the fluid entering the inlet of the compression module;

(iv) sensing the actual temperature of the lubricant mixed with the fluid in the compression module; and (v) sending the temperature data compiled in subroutine steps (i)–(iv) to the ECM.

8. The method as claimed in claim 1, wherein the step of executing a fan speed subroutine includes the steps of:

(i) comparing the actual temperature of the compressed fluid discharged from the compression module with a set point compressed fluid discharge temperature stored in the ECM memory;

(ii) increasing the speed of the fan if the actual temperature of the compressed fluid discharged from the compression module is greater than the set point fluid discharge temperature stored in the ECM memory;

(iii) comparing the actual prime mover coolant temperature with a set point prime mover coolant temperature stored in the ECM memory;

(iv) decreasing the speed of the fan if the actual prime mover coolant temperature is less than the set point prime mover coolant temperature; and (v) proceeding to the lubricant volume control subroutine if the actual prime mover coolant temperature is greater than the set point temperature stored in the ECM memory.

9. The method as claimed in claim 8, wherein the compressor includes a fan clutch in communication with the ECM and the fan for adjusting the speed of rotation of the fan.

10. The method as claimed in claim 8, further comprising the step of determining the magnitude of the increase or decrease of the speed of the fan, wherein the magnitude of the increase or decrease of the speed of the fan is based upon the empirical data stored in the ECM memory.

11. The method as claimed in claim 1, further comprising the step of storing the empirical data relating to the optimal set points of the compressor in the ECM memory.

12. The method as claimed in claim 8, wherein the step of increasing the speed of the fan increases the volume of the ambient air drawn into the compressor for decreasing the actual temperatures of the compression module and the prime mover.

13. The method as claimed in claim 8, wherein the step of decreasing the speed of the fan decreases the volume of the ambient air drawn into the compressor for increasing the actual temperature of the compression module and the prime mover.

14. The method as claimed in claim 1, wherein the empirical data relating to the optimal operating set points is compiled through evaluating the compressor for determining optimum operating characteristics.

15. The method as claimed in claim 7, wherein the executing the lubricant volume control subroutine includes the steps of:

(i) subtracting the actual temperature of the lubricant mixed with the fluid in the compression module from the actual temperature of the fluid entering the inlet of the compression module for calculating an actual temperature differential;

(ii) comparing the actual temperature differential calculated in step (i) with a predetermined set point temperature differential stored in the ECM memory;

(iii) increasing the volume of the lubricant mixed with the fluid in the compression module if the actual temperature differential is greater than the predetermined set point temperature differential;

(iv) decreasing the volume of the lubricant mixed with the fluid in the compression module if the actual temperature differential is less than the predetermined set point temperature differential.

16. The method as claimed in claim 1, wherein said lubricant includes oil.

17. The method as claimed in claim 1, wherein said fluid includes air.

18. The method as claimed in claim 1, wherein said compression module includes one or more rotors.

19. A method for optimizing the operating efficiency of a compressor having a compression module for compressing a fluid, the compression module including an inlet for receiving the fluid and an outlet for discharging compressed fluid, the compressor including a prime mover for driving the compression module and a rotatable fan for drawing ambient air into the compressor, the compressor including a first temperature sensor for sensing the temperature of compressed fluid discharged from the compression module, a second temperature sensor for sensing the temperature of a coolant circulating through the prime mover, a third temperature sensor for sensing the temperature of the fluid entering the compression module, and a fourth temperature sensor for sensing the temperature of a lubricant mixed with the fluid as the fluid is compressed in said compression module, the compressor including an electronic control module (ECM) electrically connected to the temperature sensors for receiving signals therefrom, the ECM including a non-volatile memory containing empirical data relating to optimal operating set points of the compressor and a logic routine for controlling the rotational speed of the fan and the volume of the lubricant mixed with the fluid so as to optimize the efficiency of the compressor, the method comprising the steps of:

A) executing a temperature sensing subroutine routine comprising the steps of:

(i) sensing the actual temperature of the compressed fluid discharged from the outlet of the compression module;

(ii) sensing the actual temperature of the coolant circulating through the prime mover;

(iii) sensing the actual temperature of the fluid entering the inlet of the compression module;

(iv) sensing the actual temperature of the lubricant mixed with the fluid in the compression module; and (v) sending the temperature data compiled in subroutine steps (i)–(iv) to the ECM; and then B) executing a fan speed subroutine for modulating the rotational speed of the fan comprising the steps of:

(i) comparing the actual temperature of the compressed fluid discharged from the compression module with a set point compressed fluid discharge temperature stored in the ECM memory;

(ii) increasing the speed of the fan if the actual temperature of the compressed fluid discharged from the compression module is greater than the set point fluid discharge temperature stored in the ECM memory;

(iii) comparing the actual prime mover coolant temperature with a set point prime mover coolant temperature stored in the ECM memory;

(iv) decreasing the speed of the fan if the actual prime mover coolant temperature is less than the set point prime mover coolant temperature; and (v) proceeding to the lubricant volume control subroutine if the actual prime mover coolant temperature is greater than the set point temperature stored in the ECM memory; and then C) executing the lubricant volume control subroutine comprising the steps of:

(i) subtracting the actual temperature of the lubricant mixed with the fluid in the compression module from the actual temperature of the fluid entering the inlet of the compression module for calculating an actual temperature differential;

(ii) comparing the actual temperature differential calculated in step (i) with a predetermined set point temperature differential stored in the ECM memory;

(iii) increasing the volume of the lubricant mixed with the fluid in the compression module if the actual temperature differential is greater than the predetermined set point temperature differential;

(iv) decreasing the volume of the lubricant mixed with the fluid in the compression module if the actual temperature differential is less than the predetermined set point temperature differential.

* * * * *